US010571852B2

(12) United States Patent
Tanabe et al.

(10) Patent No.: US 10,571,852 B2
(45) Date of Patent: Feb. 25, 2020

(54) IMAGE FORMING APPARATUS

(71) Applicant: CANON KABUSHIKI KAISHA, Tokyo (JP)

(72) Inventors: Yuichi Tanabe, Kashiwa (JP); Shin Hasegawa, Kawasaki (JP); Daiki Takahashi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/074,307

(22) Filed: Mar. 18, 2016

(65) Prior Publication Data

US 2016/0274530 A1 Sep. 22, 2016

(30) Foreign Application Priority Data

Mar. 20, 2015 (JP) ..... 2015-057876

(51) Int. Cl.
*G03G 21/16* (2006.01)

(52) U.S. Cl.
CPC ..... *G03G 21/1619* (2013.01)

(58) Field of Classification Search
None
See application file for complete search history.

(56) References Cited

U.S. PATENT DOCUMENTS 5,650,894 A 7/1997 Ikeda
6,636,338 B1 10/2003 Kida et al.
2002/0140914 A1 10/2002 Yamada
2011/0292151 A1 12/2011 Takahashi
2013/0293659 A1 11/2013 Suzuki et al.
2014/0002571 A1 1/2014 Aruga
2014/0186068 A1* 7/2014 Kobayashi ..... G03G 21/1647 399/90
2014/0239145 A1 8/2014 Miyakoshi
2015/0055973 A1 2/2015 Choi et al.

FOREIGN PATENT DOCUMENTS

CN 103383490 A 11/2013
GB 2177535 A 1/1987
JP 626458 A 1/1987
JP 08-278670 A 10/1996
JP 09-146324 A 6/1997
JP 2000122382 A 4/2000
(Continued)

OTHER PUBLICATIONS

JP 2003191569 English machine translation, Asano, dated Jul. 2003.*

(Continued)

*Primary Examiner* — Thomas S Giampaolo, II
(74) *Attorney, Agent, or Firm* — Venable LLP

(57) ABSTRACT

An image forming apparatus includes an image forming unit configured to form an image; a holding portion configured to hold the image forming unit; a supporting portion configured to support the holding portion; a fastening portion configured to fasten the holding portion and the supporting portion to each other; and an arcuate slit portion provided in at least one of the holding portion and the supporting portion and extending substantially about the fastening portion in a range at least not less than 180° and less than 360° around the fastening portion.

7 Claims, 12 Drawing Sheets

(56) References Cited

FOREIGN PATENT DOCUMENTS

| | | | |
|---|---|---|---|
| JP | 2000-292277 | A | 10/2000 |
| JP | 2001154436 | A | 6/2001 |
| JP | 2001235699 | A | 8/2001 |
| JP | 2003-191569 | A | 7/2003 |
| JP | 2004220047 | A | 8/2004 |
| JP | 2005-059380 | A | 3/2005 |
| JP | 2011248235 | A | 12/2011 |
| JP | 2013-025187 | A | 2/2013 |
| JP | 2013054082 | A | 3/2013 |
| JP | 2013-200567 | A | 10/2013 |
| JP | 2014126838 | A | 7/2014 |
| JP | 2014164775 | A | 9/2014 |

OTHER PUBLICATIONS

Search Report issued in corresponding European Patent Application No. 16160358.4 dated Aug. 22, 2016.
Korean Office Action issued in corresponding Korean Application No. 10-2016-0032720 dated Oct. 24, 2018.
Japanese Office Action issued in corresponding Japanese Application No. 2015057876 dated Jan. 15, 2019.
Chinese Office Action issued in corresponding Chinese Application No. 20161054379.0 dated Mar. 22, 2019.
Japanese Office Action issued in corresponding Japanese Application No. 2015-057876 dated Apr. 16, 2019.
Korean Office Action issued in corresponding Korean Application No. 10-2016-0032720 dated May 10, 2019.

* cited by examiner (a)

(b)

(c)

(a)

(b)

(c)

(a)

(b)

(c)

(a)

(b)

(c)

IMAGE FORMING APPARATUS

FIELD OF THE INVENTION AND RELATED ART

The present invention relates to an image forming apparatus such as a copying machine, a printing machine, a facsimile machine, a multifunction machine having two ore more functions of the preceding machines, and so on.

An electrophotographic image forming apparatus forms an electrostatic latent image on an image bearing component such as a photosensitive drum, with the use of an image forming section having an exposing device or the like, and turns the electrostatic latent image into a visible image with the use of toner. An exposing device and a photosensitive drum (component on which an image is formed), such as those mentioned above, are attached to the main frame of the image forming apparatus with the use of stays or the like. To the main frame, a motor for driving the photosensitive drum, developing device, a fixing device, etc., and a driving force transmitting device such as gears, are attached. Thus, if the vibrations from the driving force transmitting device travel to the exposing device and/or photosensitive drum, it is possible that image defects such as pitch anomaly will occur.

Therefore, there has been proposed an image forming apparatus structured so that its exposing device is supported with the main frame of the apparatus, with the placement of a shock absorbing component between the exposing device and main frame (Japanese Laid-open Patent Application No. H09-146324). There has also been proposed an image forming apparatus structured so that its exposing device is supported by a stay or the like, with the placement of an elastic component between one of the four points of the exposing device, by which the exposing device is held to the stay, and the stay (Japanese Laid-open Patent Application No. H08-278670).

However, in the case of the image forming apparatus structured as disclosed in Japanese Laid-open Patent Application No. H09-146324, the exposing device is supported by the main frame of the apparatus, with the placement of a shock absorbing component between the exposing device and the main frame. Thus, it is impossible to ensure that the exposing device is precisely positioned relative to the photosensitive drum. Therefore, an additional structural arrangement is necessary to keep the exposing device precisely positioned relative to the photosensitive drum. Thus, the image forming apparatus increases in component count, and also, the main assembly of the apparatus becomes complicated in structure.

Further, in the case of the image forming apparatus structured as disclosed in Japanese Laid-open Patent Application No. H08-278670, it is only one of the four points at which the exposing device is held by the main frame of the apparatus, that is provided with elasticity. Thus, as long as vibrations are transmitted to the exposing device through a specific path, that is, only when the vibrations are transmitted through this point having elasticity, it can be expected that the amount by which vibrations are transmitted to the exposing device will reduce. That is, in a case where vibrations are transmitted to an exposing device through multiple paths, it is difficult to reduce the amount by which vibrations are transmitted to an exposing device.

SUMMARY OF THE INVENTION

Thus, the primary object of the present invention is to provide an image forming apparatus, the main frame of which supports the image forming components, and is significantly smaller in the amount by which vibrations are transmitted to its image forming components, than any conventional image forming apparatus.

According to an aspect of the present invention, there is provided an image forming apparatus comprising an image forming unit configured to form an image; a holding portion configured to hold said image forming unit; a supporting portion configured to support said holding portion; a fastening portion configured to fasten said holding portion and said supporting portion to each other; and an arcuate slit portion provided in at least one of said holding portion and said supporting portion and extending substantially about said fastening portion in a range at least not less than 180° and less than 360° around said fastening portion.

Further features of the present invention will become apparent from the following description of exemplary embodiments with reference to the attached drawings.

Figure 1:
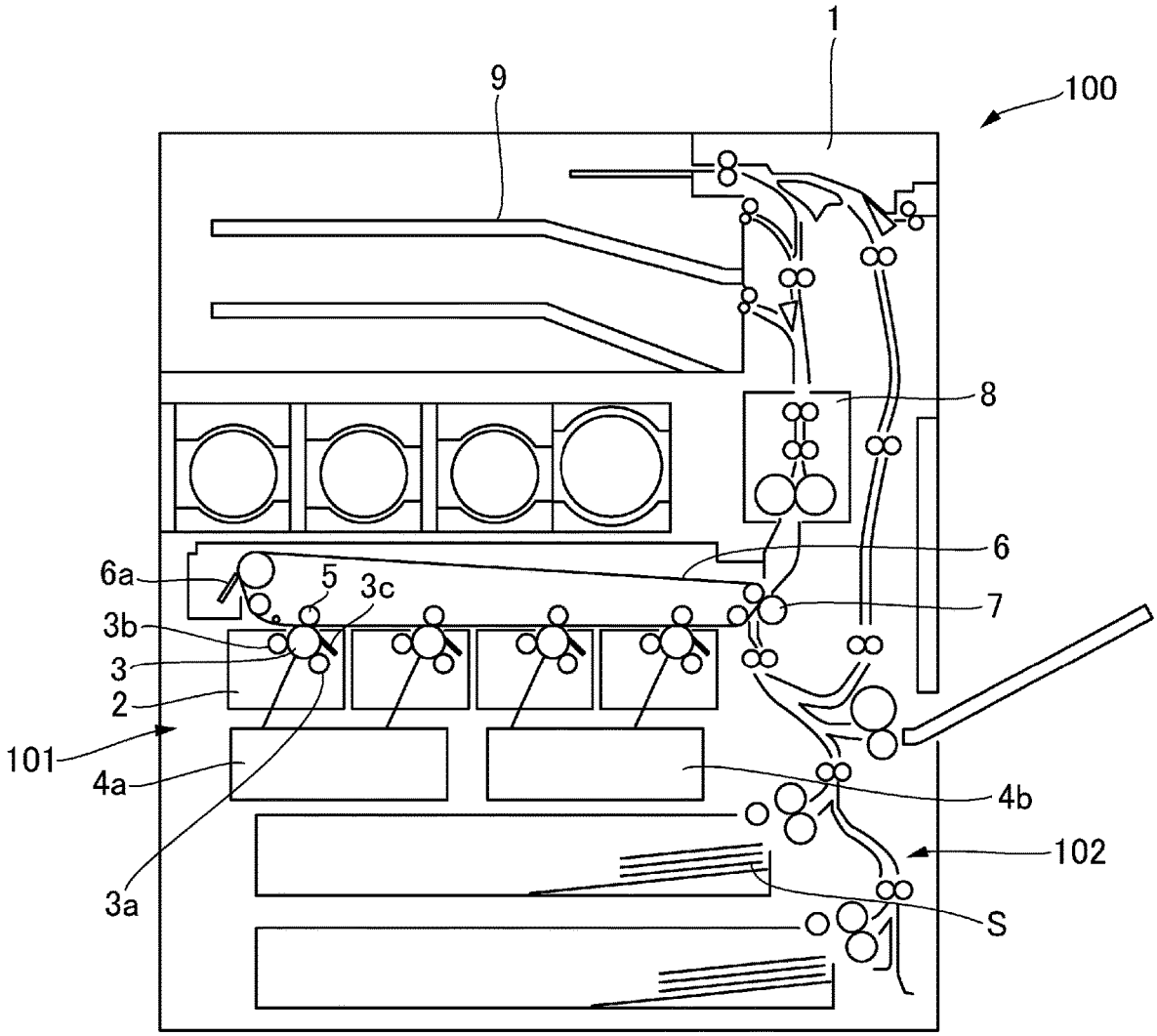
FIG. 1 is a schematic drawing of the image forming apparatus in the first embodiment of the present invention, which shows the general structure of the apparatus.
Figure 2:
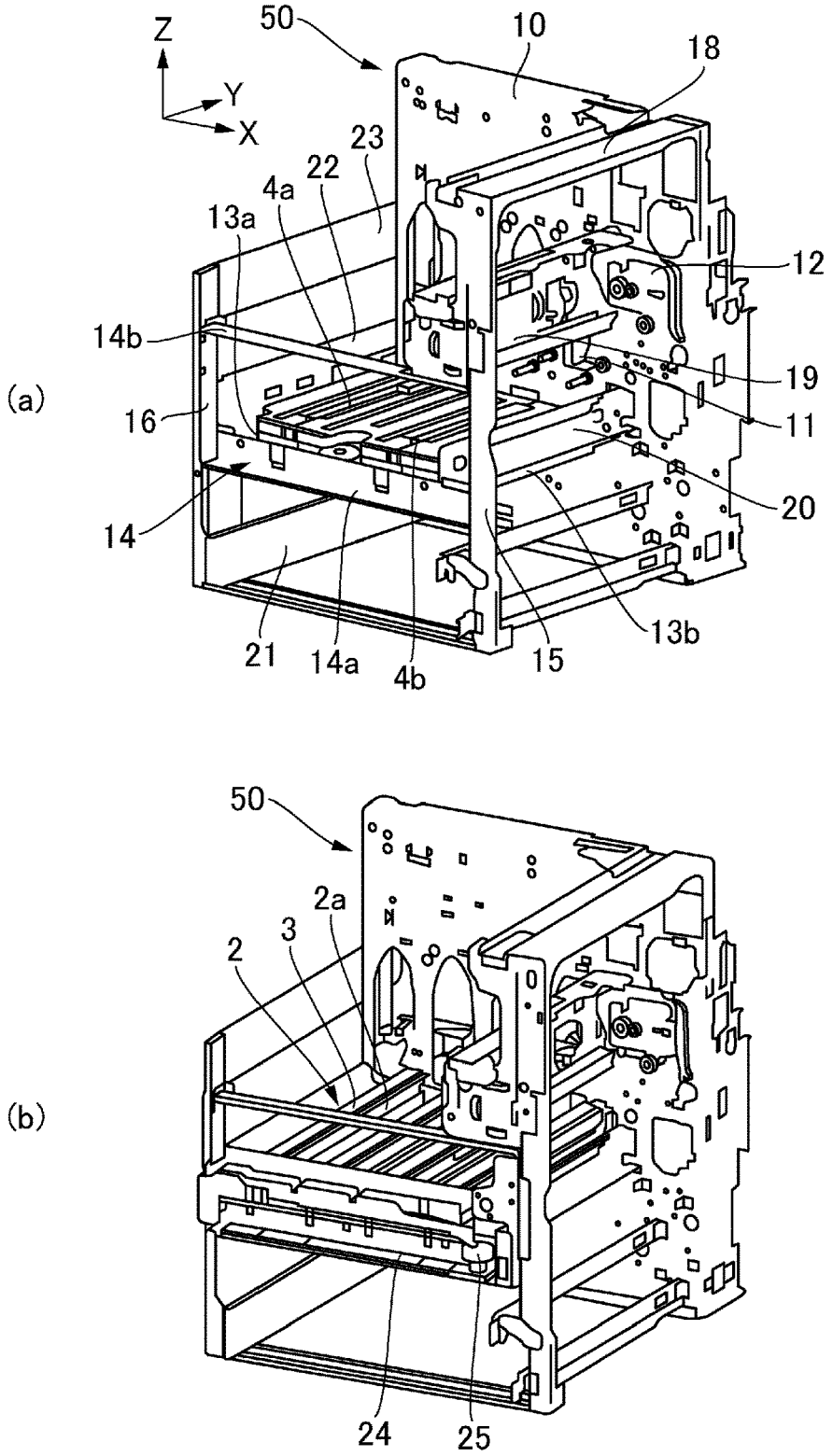

Part (a) of FIG. 2 is a perspective view of the combination of the main frame and scanner unit of the image forming apparatus in the first embodiment, after the installation of the scanner unit in the main frame, and part (b) of FIG. 2 is a perspective view of the combination of the main frame of the image forming apparatus, and process cartridges therein, in the first embodiment, after the installation of the process cartridges into the main frame.

Figure 3:
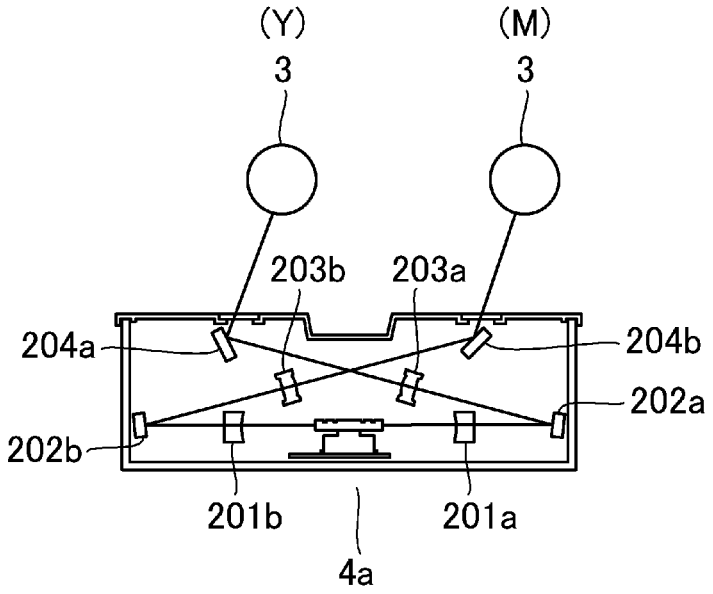

FIG. 3 is a schematic drawing of the scanner unit in the first embodiment, which is for showing the structure of the scanner unit.

Figure 4:
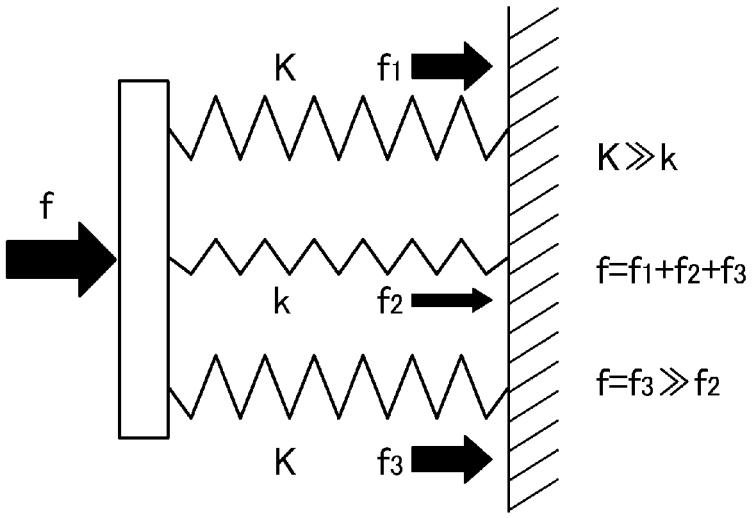

FIG. 4 is a schematic drawing for describing the relationship between the rigidity of the vibration path and the amount of load (vibrations) transmitted through the vibration path.

Figure 5:
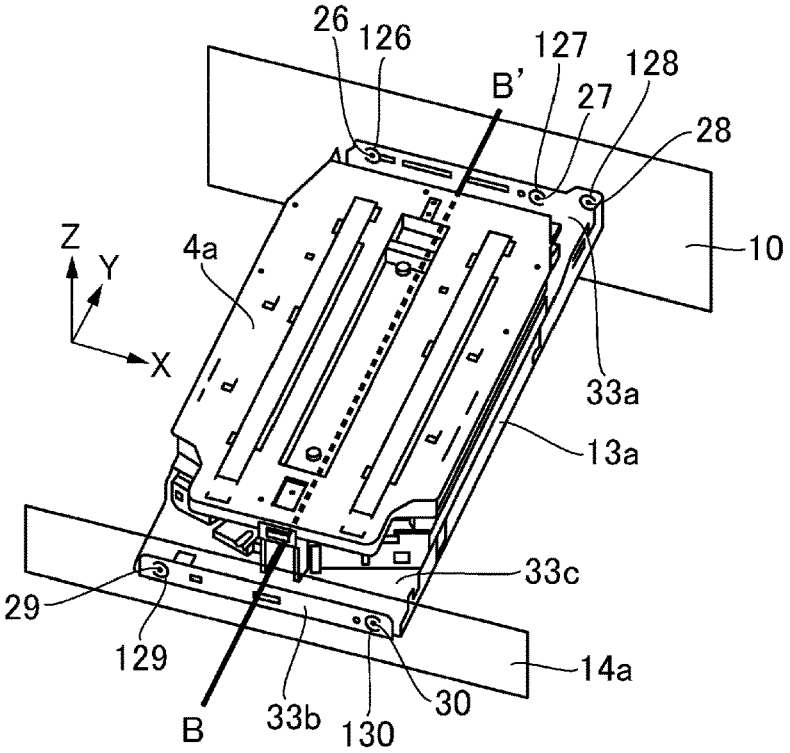

FIG. 5 is a perspective view of the combination of the scanner unit, and the structure by which the scanner unit is supported, in the first embodiment.

Figure 6:
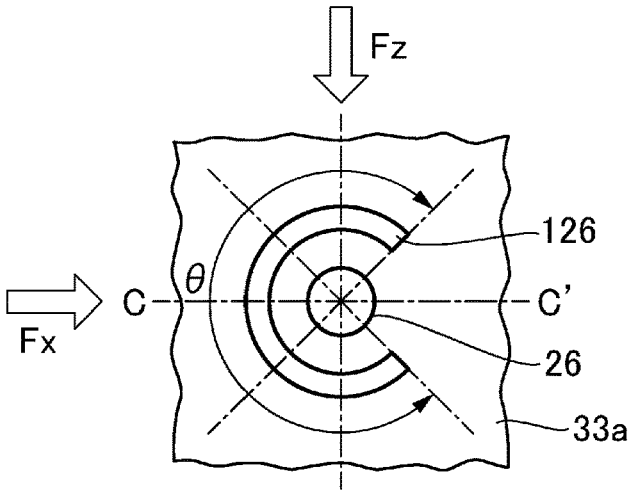

FIG. 6 is a plan view of the bent section of the scanner stay, which shows the connective section of the bent section, and the slit provided in the adjacencies of the connective section.

Figure 7:
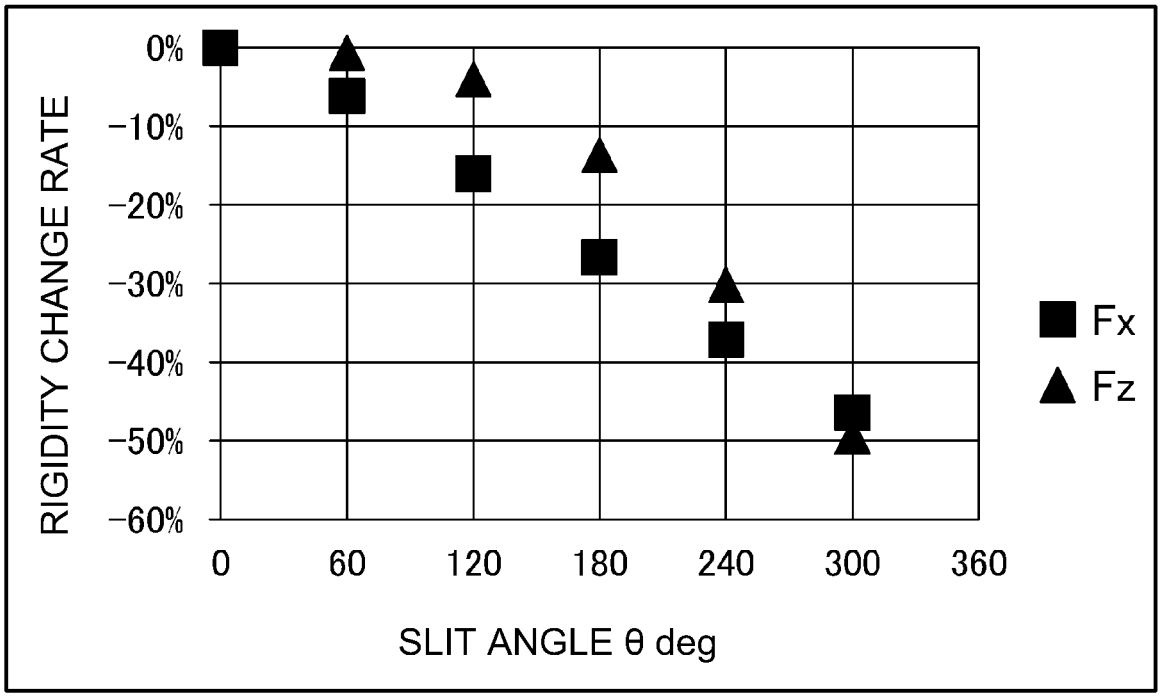

FIG. 7 is a graph which shows the relationship between the angle (length) by which the slit encircles (concentrically extends around) the connective section, and the ratio by which the vibration path is reduced in rigidity.

Figure 8:
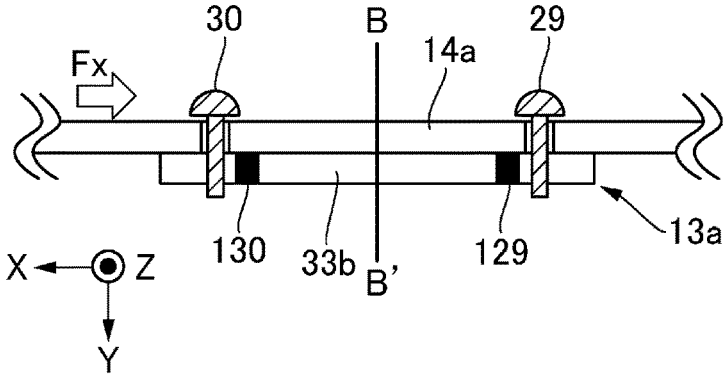
Figure 8:
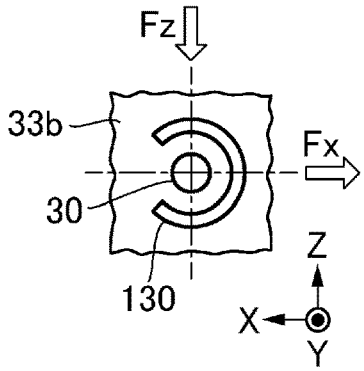
Figure 8:
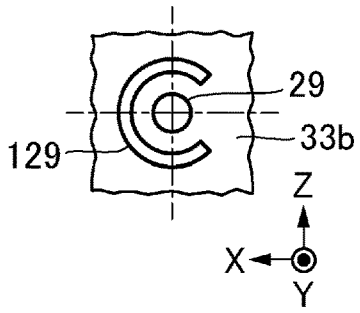

Part (a) of FIG. 8 is a sectional view of where the front stay and scanner stay are connected to each other in the first embodiment; part (b) of FIG. 8, a plan view of the left connective section of the bent section of the scanner stay, and the slit provided in the adjacencies of the connective section, shown in part (a) of FIG. 8, which is for showing the shape of the slit; and part (c) of FIG. 8 is a plan view of the right connective section of the bent section of the scanner stay, and the slit provided in the adjacencies of the connective section, shown in part (a) of FIG. 8, which is for showing the shape of the slit.

Figure 9:
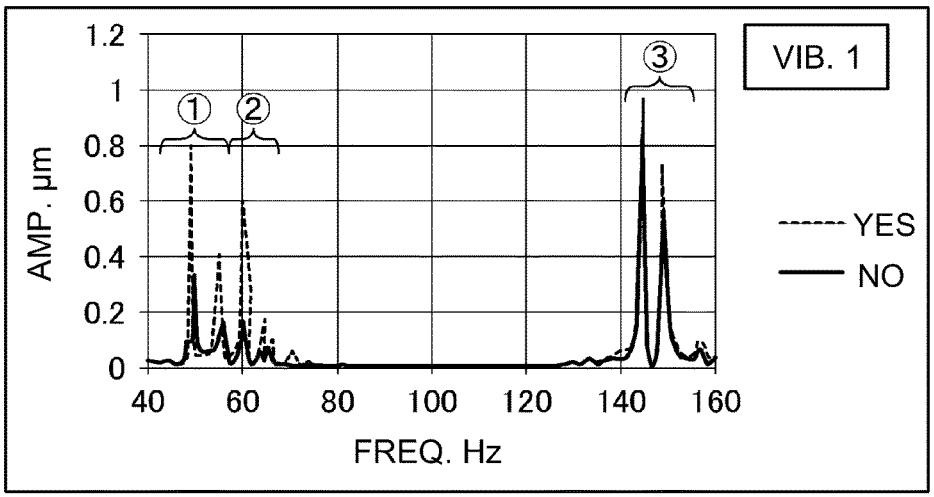
Figure 9:
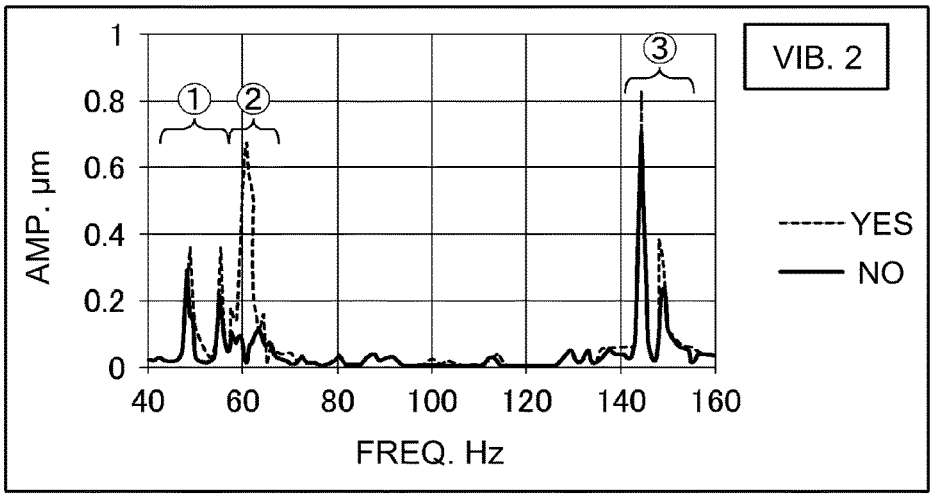
Figure 9:
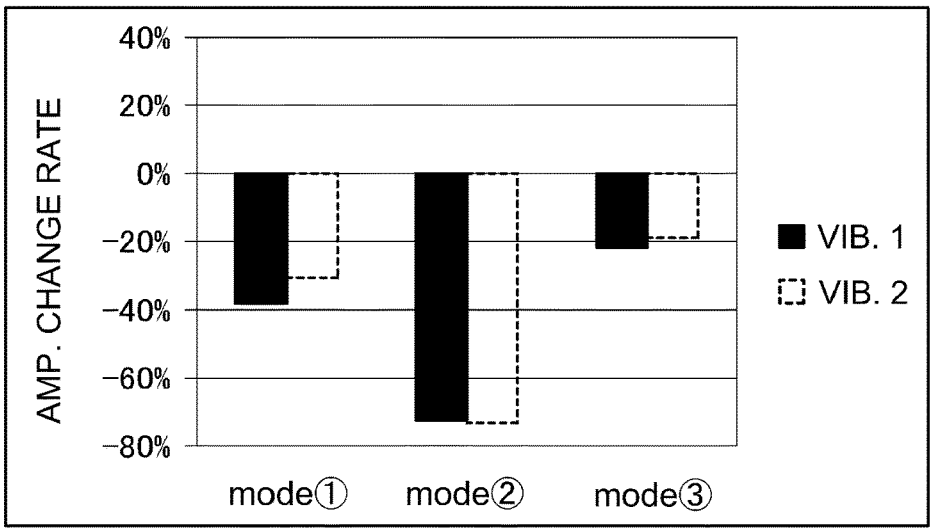

Part (a) of FIG. 9 is a graph which shows the relationship between the frequency and amplitude in the tests carried out to confirm the effects of the first embodiment, under the first condition (vibration 1); part (b) of FIG. 9, a graph which shows the relationship between the frequency and amplitude in the tests carried out to confirm the effects of the first embodiment, under the second condition (vibration 2); and part (c) of FIG. 9 is a graph which shows the relationship between the change, in terms of ratio, in the amplitude of the vibration, and the three specific vibration transmission paths (channel).

Figure 10:
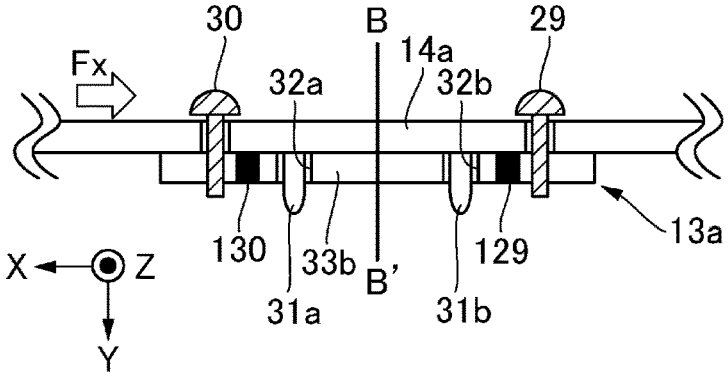
Figure 10:
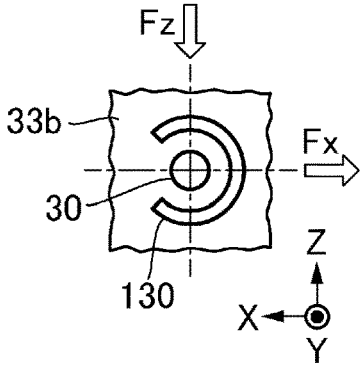
Figure 10:
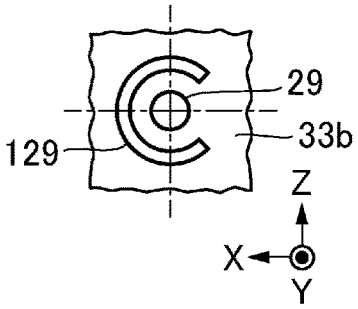

Part (a) of FIG. 10 is a sectional view of where the front stay and scanner stay are connected to each other in the second embodiment; part (b) of FIG. 10, a plan view of the left connective section of the bent section of the scanner stay, and the slit provided in the adjacencies of the connective section, shown in part (a) of FIG. 10, which is for showing the shape of the slit; and part (c) of FIG. 10 is a plan view of the right connective section of the bent section of the scanner stay, and the slit provided in the adjacencies of the connective section, shown in part (a) of FIG. 10, which is for showing the shape of the slit.

Figure 11:
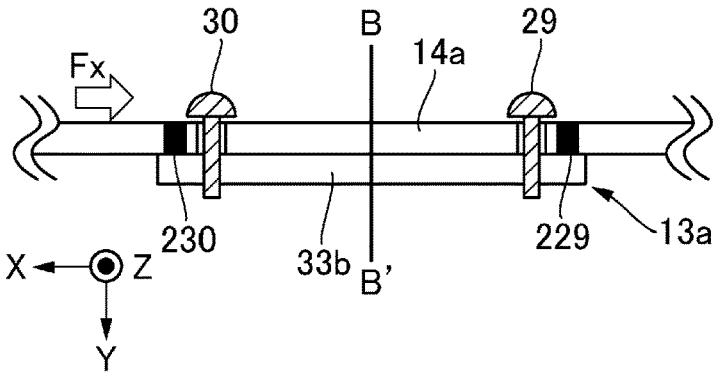
Figure 11:
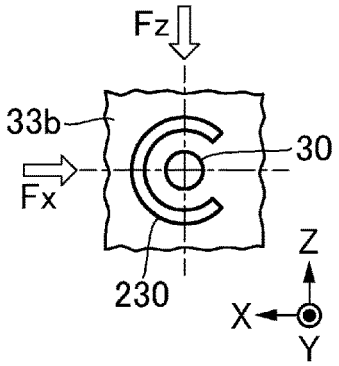
Figure 11:
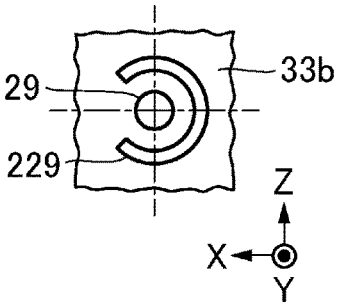

Part (a) of FIG. 11 is a sectional view of where the front stay and scanner stay are connected to each other in the third embodiment; part (b) of FIG. 11, a plan view of the left connective section of the bent section of the scanner stay, and the slit provided in the adjacencies of the connective section, shown in part (a) of FIG. 11, which is for showing the shape of the slit; and part (c) of FIG. 11 is a plan view of the right connective section of the bent section of the scanner stay, and the slit provided in the adjacencies of the connective section, shown in part (a) of FIG. 11, which is for showing the shape of the slit.

Figure 12:
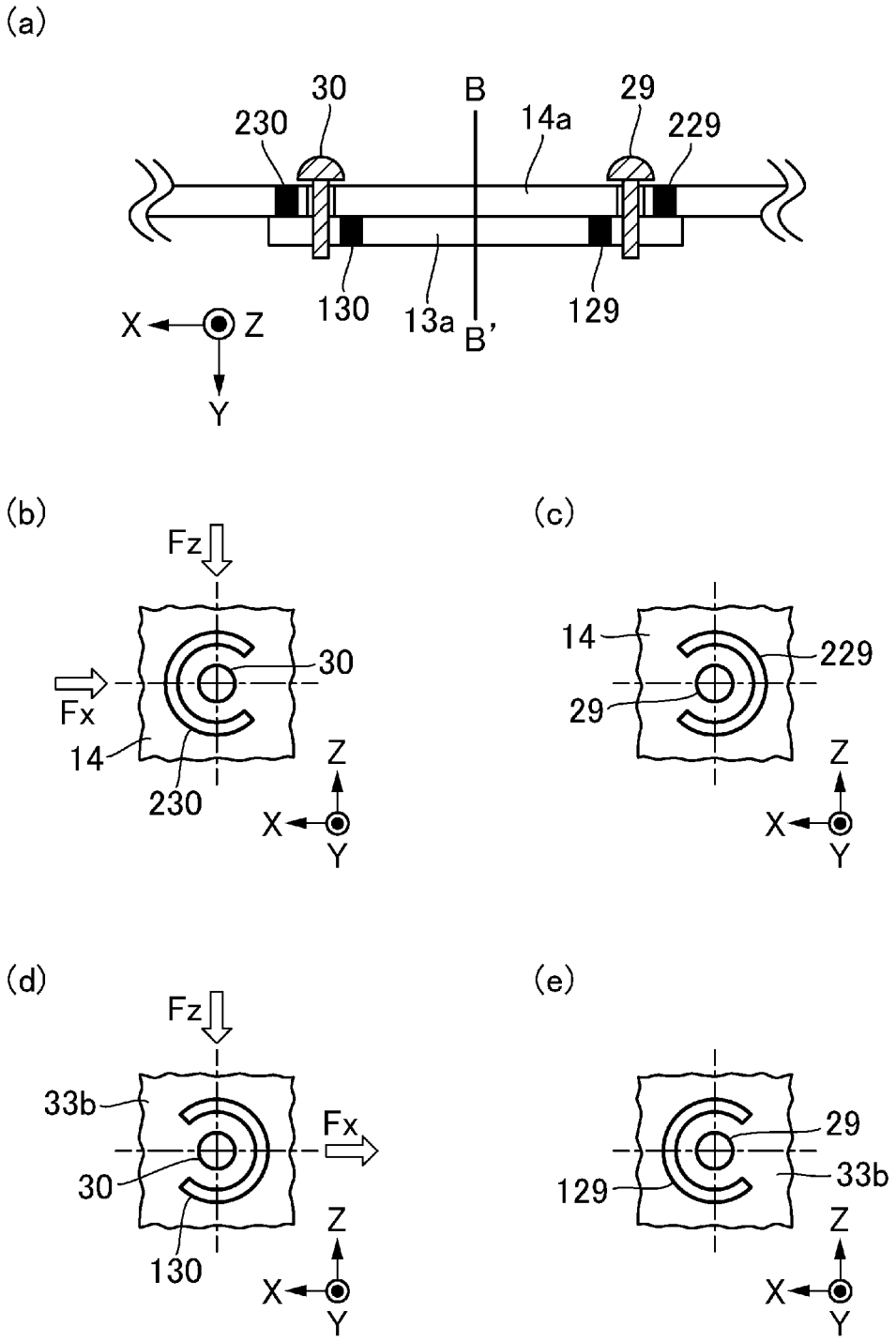

Part (a) of FIG. 12 is a sectional view of where the front stay and scanner stay are connected to each other in the fourth embodiment; part (b) of FIG. 12, a plan view of the left connective section of the bent section of the scanner stay, and the slit provided in the adjacencies of the connective section, shown in part (a) of FIG. 12, which is for showing the shape of the slit; part (c) of FIG. 12, a plan view of the right connective section of the scanner stay, and the slit provided in the adjacencies of the connective section, shown in part (a) of FIG. 12, which is for showing the shape of the slit; part (d) of FIG. 12, a plan view of the left connective section of the scanner stay, and slit provided in the adjacencies of the connective section, shown in part (a) of FIG. 12, which is for showing the shape of the slit; and part (e) of FIG. 12 is a plan view of the right connective section of the scanner stay, and the slit provided in the adjacencies of the connective section, shown in part (a) of FIG. 12, which is for showing the shape of the slit.

Figure 13:
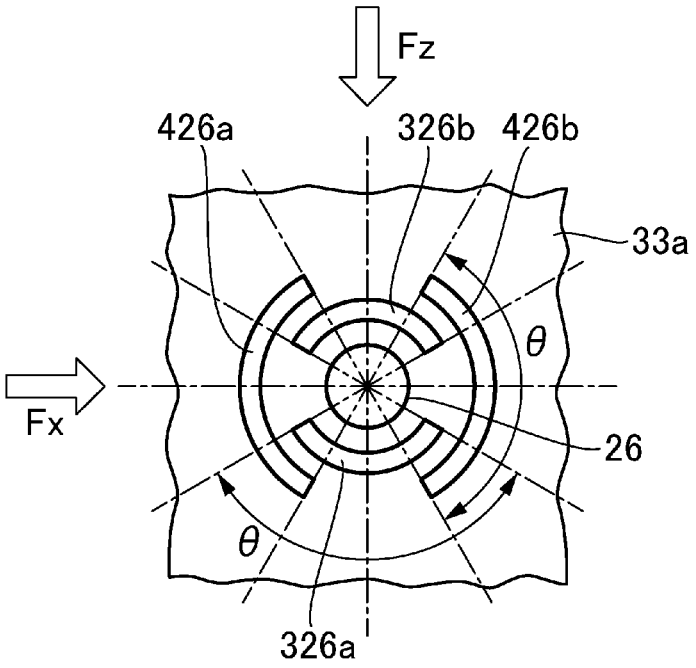

FIG. 13 is a plan view of the combination of the connective section, and the slits provided in the adjacencies of the connective section, in the fifth embodiment, which is for showing the shape of the slits.

Figure 14:
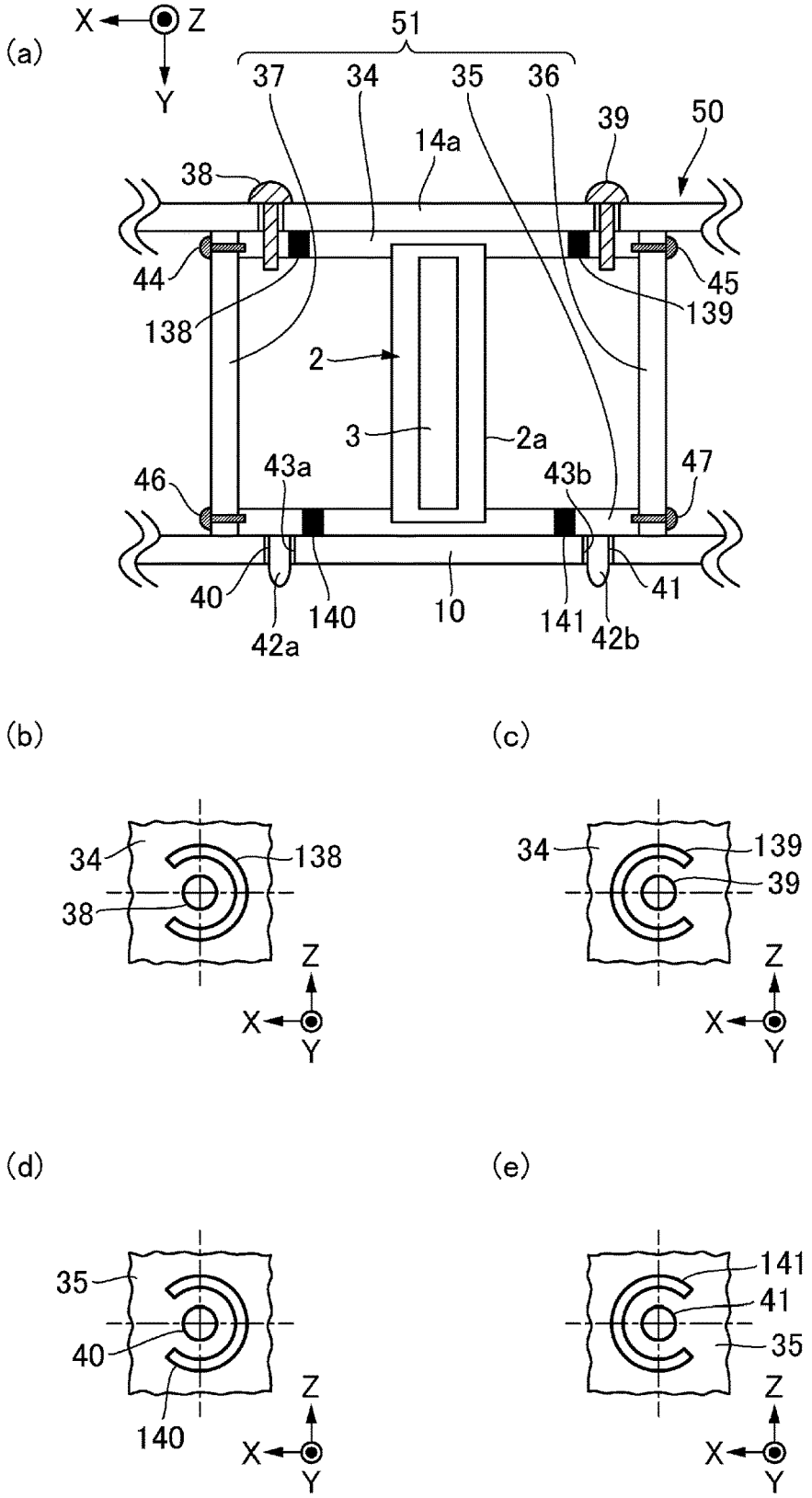

Part (a) of FIG. 14 is a sectional view of where the front stay, rear plate, and cartridge holding frame are connected to each other; part (b) of FIG. 14, a plan view of the top-left connective section, and the slits provided in the adjacencies of the connective section, shown in part (a) of FIG. 14, which is for showing the shape of the slit; part (c) of FIG. 14, a plan view of the top-right connective section, and the slit provided in the adjacencies of the connective section, shown in part (a) of FIG. 14, which is for showing the shape of the slit; part (d) of FIG. 14, a plan view of the bottom-left connective section, and the slit provided in the adjacencies of the connective section, shown in part (a) of FIG. 14, which is for showing the shape of the slit; and part (e) of FIG. 14 is a plan view of the bottom-right connective section, and the slit provided in the adjacencies of the connective section, shown in part (a) of FIG. 14, which is for showing the shape of the slit.

DESCRIPTION OF THE EMBODIMENTS

Embodiment 1

Next, referring to FIGS. 1-9, the first embodiment of the present invention is described. To begin with, referring to FIG. 1, the overall structure of the image forming apparatus in this embodiment is described.

[Image Forming Apparatus]

The image forming apparatus 100 in this embodiment is a full-color printer which uses an electrophotographic image forming method. An image forming apparatus such as the image forming apparatus 100 has: an image forming section 101 which forms a toner image; and a recording medium conveying section 102 which conveys recording medium (sheet of paper, OHP film, etc.), onto which a toner image formed by the image forming sections 101 are transferred. The image forming section 101 has the so-called tandem type structure. That is, it is structured so that multiple process cartridges 2 are aligned in tandem in the direction parallel to the direction in which the intermediary transfer belt 6 of the apparatus 100 is moved. In the multiple image forming stations of the image forming sections, yellow, magenta, cyan and black toner images are formed, one for one.

An image forming apparatus such as the one in this embodiment is structured so that multiple (four in this embodiment) process cartridges 2 can be removably installed in the main assembly 1 of the apparatus 100. Here, the four process cartridges 2 are the same in structure. Hereafter, therefore, only the leftmost process cartridge 2 is described as the one which represents all the process cartridges 2 (referential suffixes which indicate color of toner they form, and their position in terms of moving direction of intermediary transfer belt, are not shown).

The process cartridge 2 has a photosensitive drum 3, a charge roller 3*a*, a developing device 3*b*, and a drum cleaner 3*c*. The photosensitive drum 3 is an image bearing component (image forming component). It is an electrophotographic photosensitive component, and is in the form of a drum. It is rotationally driven by an unshown drum motor, at a preset process speed. The peripheral surface of the photosensitive drum 3 is uniformly charged by the charge roller 3*a* as a charging means. As the uniformly charged peripheral surface of the photosensitive drum 3 is scanned by the beam of laser light projected by a pair of scanner units 4*a* and 4*b*, which are image forming components (image forming sections (exposing means), while being modulated according to the information about the image to be formed, an electrostatic image is effected on the peripheral surface of the photosensitive drum 3. The electrostatic latent image on the photosensitive drum 3 is developed into a developer image T (toner image), that is, an image formed of developer (toner), through a process of adhering toner to the electrostatic image with the use of the developing device 3*b*. Then, the toner image on the photosensitive drum 3 is transferred (primary transfer) onto the intermediary transfer belt 6 by the application of the primary transfer bias between a primary transfer roller 5, as the primary transferring means, and the photosensitive drum 3. The transfer residual toner, which is the toner remaining on the peripheral surface of the photosensitive drum 3 after the primary transfer, is removed by the drum cleaner 3*c*.

As a process such as the above-described one is carried out by each process cartridge 2, four toner images, different in color, are formed on the four photosensitive drums 3 in the four process cartridges 2, one for one, and are transferred in layers onto the intermediary transfer belt 6. Consequently, a full-color image is effected on the intermediary transfer belt 6. Then, the toner images on the intermediary transfer belt 6 are transferred (secondary transfer) onto a sheet of recording medium conveyed to the secondary transferring section formed by the intermediary transfer belt 6 and a secondary transfer roller as the secondary transferring means, by a recording medium conveying section 102, which will be described later. The toner remaining on the intermediary transfer belt 6 after the secondary transfer is removed by a belt cleaner 6*a*.

The recording medium conveying section 102 is made up of multiple conveyance rollers. It picks up sheets of recording medium stored in a cassette 102*a*, and conveys the sheets to the secondary transferring section of the image forming section 101. Regarding the conveyance of a sheet of recording medium to the secondary transferring section, each sheet of recording medium is delivered to the secondary transferring section by a pair of registration rollers 102*b* so that the sheet arrives at the secondary transferring section with the same timing as the toner images on the intermediary transfer belt 6. In the case of the image forming apparatus 100 shown in FIG. 1, a sheet of recording medium is conveyed upward of the main assembly of the image forming apparatus 100 from the cassette 102*a* disposed in the bottom portion of the main assembly. That is, the recording medium conveying section 102 is disposed so that it extends upward in the roughly vertical direction, on one side (right side as seen from front side of apparatus) of the main assembly.

After the transfer of the toner images onto a sheet of recording medium in the secondary transferring section, the sheet and the toner images thereon are heated and pressed by a fixing device 8. Consequently, the toner images are fixed to the sheet. After the fixation of the toner images to the sheet, the sheet is discharged into a delivery tray 9.

[Structure of Main Frame]

Next, referring to FIG. 2, the main frame 50 of the main assembly 1 of the image forming apparatus 100 is described. The main frame 50 is made up of a rear plate 10, a front plate unit 14, connective stays 18, 19, 20, 21, 22, 23, etc., which connect the rear plate 10 and front plate unit 14 to each other. The front plate unit 14 is made up of a front stay 14*a*, a top-front stay 14*b*, a right supporting column 15, a left supporting column 18, which are connected to each other. Each of the connective stays 18-23 are connected to the left or right ends of the rear plate 10 and front plate unit 14, with the use of small screws or like components.

A main driving unit 11 and a fixing device driving unit 12 are driving force transmitting devices, and are vibration sources. They are supported by the rear plate 10, by being held to the rear plate 10 with the use of small screws. As described above, the rear plate 10 makes up a part of the main frame 55 by being connected to the front plate unit 14 with the use of connective stays 18-23. Thus, the main frame 50, which includes the rear plate 10, makes up the section of the image forming apparatus 100, by which the driving force transmitting devices are supported. The main driving unit 11 has a combination of a motor, a gear train, etc., which are for driving the photosensitive drum 3 and developing device 3*b* in each of the above-described process cartridges 2, a combination of a motor, a gear train, etc., which are for driving the driver roller for the intermediary transfer belt 6, etc. The fixing device driving unit 12 has a combination of a motor, a gear train, etc., which are for driving the above-described fixing device 8.

Referring to part (a) of FIG. 2, a pair of scanner stays 13*a* and 13*b* are supporting sections for supporting the scanner units 4*a* and 4*b*, each of which is an optical exposing device, and are connected in parallel to multiple points (three points in this embodiment) of the rear plate 10 with the use of small screws. Further, the pair of scanner stays 13*a* and 13*b* are connected to multiple points (two points in this embodiment) of the front stays 14, with the use of small screws. In other words, the scanner stays 13*a* and 13*b* are fixing components for fixing the scanner units 4*a* and 4*b*, as image forming sections, to the main frame 50.

Referring to part (b) of FIG. 2, four shells 2*a* of four process cartridges 2, one for one, each of which holds the photosensitive drum 3 which is an image bearing component, are supported in parallel by the main frame 50. The front side (−Y side) of the shell 2*a* is held by the cartridge holding sub-frame 24, which is held to the front stay 14*a*, shown in part (b) of FIG. 2, with the use of small screws. By the way, the cartridge holding sub-frame 24 is made up of multiple structural components connected to each other with the use of small screws. Further, the toner recovery device driving unit 25, as a driving force transmitting device, which is a vibration source, is held to the top surface of the cartridge holding sub-frame 24. The toner recovery device driving unit 25 has a combination of a motor, a gear trains, etc., for driving a conveyance screw for sending to an unshown recovery container, the toner discharged from each process cartridge 2.

[Scanner Unit]

Next, referring to FIG. 3, the positioning of the optical system of each of the pair of scanner units 4*a* and 4*b* fixed to the main frame 50 as described above is described. Since the scanner units 4*a* and 4*b* are the same in structure, FIG. 3 shows only the scanner unit 4*a*. The scanner unit 4*a* bears a role of exposing two photosensitive drums 1. More specifically, in this embodiment, it bears the role of exposing the photosensitive drum 3 which corresponds to the yellow (Y), and the photosensitive drum 3 which corresponds to the magenta (M) components of the image to be formed, whereas the scanner unit 4*b* bears the role of exposing the photosensitive drums 3 which correspond to the cyan (C) and black (Bk) components of the image to be formed. Thus, the scanner unit 4*a* has the first scanning path which leads to the photosensitive drum 3 for the Y component, and the second scanning path which leads to the photosensitive drum 3 for the M component. It is provided with the first mirror opening 202*a*, which is between a pair of fθ lenses 201*a* and 203*a*, which are in the first scanning path. It is also provided with the second mirror 204*a* which is on the downstream side of the fθ lens 203*a*, in terms of the direction in which the beam of laser light in projected, in the first scanning path. Thus, the beam of laser light is guided to the photosensitive drum 3 for the Y component, by being deflected twice. Further, the scanner unit 4*a* is provided with the first mirror 202*b* which is positioned between a pair of fθ lenses 201*b* and 203*b*, in the laser beam path in the second scanning path. It is also provided with the second mirror 204*b*, which is positioned on the downstream side of the fθ lens 203*b* in terms of the direction in which the beam of laser light is projected. Thus, the beam of laser light for the M component is guided to the photosensitive drum 3 by being deflected twice.

[Countermeasure to Vibration]

As described above, the main driving unit 11 for operating the photosensitive drum 3 and developing device 3*b*, etc., and the fixing device driving unit 12 for driving the fixing device 8, are made up of a motor and a gear train. They are attached to the rear plate 10. When an image is formed by an image forming apparatus structured as described above, vibrations occur in the main driving unit 11 and fixing device driving unit 12. The occurrence of these vibrations is primarily attributable to the meshing between the gears of the gear trains of the driving units, and the rotational imbalance of the motors.

Thus, as the vibrations which occurred in the driving units transmit through the main frame 50 and reach the scanner units 4*a* and 4*b*, the scanner unit 4*a* and 4*b* themselves, and/or the optical components such as mirrors and lenses in the scanner units 4*a* and 4*b*, are made to vibrate by the vibrations from the driving units. If the frequency of the vibrations from the motors and gear trains is the same as the natural frequency of the scanner units 4*a* and 4*b*, and/or the optical components of the units 4*a* and 4*b*, the vibrations are amplified in amplitude. Consequently, the beams of laser light projected from the scanner units 4*a* and 4*b* are caused to periodically deviate from the intended point on the peripheral surface of the photosensitive drum 3, causing thereby the image forming apparatus to output an image which suffers from periodic illusional strips, that is, an image defect which is referred to as "pitch anomaly". In this embodiment, therefore, the amount by which the vibrations generated in the driving units are transmitted to the scanner units 4*a* and 4*b* is minimized with a structural arrangement, which will be described later.

Next, the method, in this embodiment, for reducing the amount by which vibrations are transmitted from the driving units to the scanner units 4*a* and 4*b*, is described in terms of principle. There is the following relationship among amplitude X [mm] of vibration at a point of evaluation of a structural component, an amount F [N] of load inputted into the structural component, and the transfer function H [mm/N] (vibration, per unit load, of given point):

$$X=F\cdot H \tag{1}$$

Adaptation of X, F and H in Equation (1) to the problems related to the above-described image defect which attributable to the vibrations of the scanner units 4*a* and 4*b*, and those of the internal components of the scanner units 4*a* and 4*b* leads to the following deduction.

To begin with, the vibration X of a point of evaluation is that of the second mirror 204*a*, which is the point of final beam deflection in the scanner unit 4*a*, and which is closely correlated to pitch anomaly. Assuming here that the structures, the characteristics of which are definable by the equation (1), are the scanner unit 4*a* and scanner stay 13*a*, the amount of the inputted load F is the amount of load injected into these structures. Thus, the amount of input load F may be thought to be the amount of load which transmits through the rear plate 10 and front plate unit 14, and causes the scanner stay 13*a* to vibrate. Further, the transfer function H of each of these structures can be expressed as the transfer characteristics of the portion of each structure, which is from the point of connection between the lateral plate of the scanner stay 13*a*, to the second mirror 204*a*, or the point of beam deflection.

Here, one of possible methods for reducing vibration X at the point of evaluation (vibration of optical component) is to reduce the transfer function H. For example, it is possible to increase the scanner stay 13 in thickness, and/or the number of times it is bent in the direction perpendicular to its lengthwise direction, or provide the scanner unit 4*a* with internal ribs, in order to increase the rigidity of scanner stay 13. It is also possible to attach an elastic component to the optical components (second deflection mirror 204*a*, for example) to reduce the amount by which the optical components resonate with the vibrations transmitted thereto, in a specific mode. Both methods require additional measures, which results in cost increase. In the present invention, therefore, as the method for reducing vibration X at the point of evaluation in attention was paid to the amount of input load F, that is, the amount by which input load is transmitted to the scanner 13*a* through the lateral plate, instead of the transfer function H.

Next, the method for reducing the input load F is described. Generally speaking in terms of static rigidity, it has been known that if force is transmitted through a component that is made up two sections, which are different in rigidity, the component transmits more force through the section which is higher in rigidity than the section which is lower in rigidity. For example, referring to FIG. 4, it is assumed here that a load f is transmitted through a component made of multiple sections (vibration transmission paths) which are different in rigidity; the rigidity K of the top and bottom paths is greater than the rigidity k of the middle path. In this case, the amount f2 by which the load is transmitted through the center path is smaller than the amounts f1 and f3 by which the load f is transmitted through the top and bottom paths, respectively. Thus, it is evident that if it is wanted to reduce the amount of load transmission in a specific path of a structural component having multiple load transmission paths, all that is necessary is to make the specific path less rigid than the other paths.

If it possible to apply concept such as the above-described one to an issue related to vibration, all that is necessary is to make the load path from each of the driving units which are the vibration sources, to the scanner stay 13*a*, smaller in rigidity than other load paths. With the load path from each of the driving units to the scanner stay 13*a* being smaller in rigidity than the other load paths, the amount by which the input load F, which causes the scanner stay 13*a* to vibrate, is transmitted to the scanner stay 13*a*, becomes smaller, and therefore, it becomes possible to reduce the amount of vibration X in the second deflection mirror 204*a*.

In the present invention, the lateral plate is not considered to be related to transfer function H. Instead, it is thought as a structural component (that is, input load F) which transmits load, for the following reason. That is, it is based on conventional knowledge that the specific mode of the lateral plate by which the driving units are held has virtually no effect upon the vibration X of an evaluation point (vibration of optical component).

[Concrete Structural Arrangement as Countermeasure to Vibrations]

Next, referring to FIGS. 5-8, the concrete structural arrangement as countermeasure to the vibrations, in this embodiment, is described. FIG. 5 is a portion of the main structure, shown in FIG. 2, to which the scanner units 4*a* and 4*b* are fixed. By the way, hereinafter, only the scanner unit 4*a* and scanner stay 13*a* are described in detail. The description of the scanner unit 4*b* and scanner stay 13*b* are the same as those of the scanner unit 4*a* and scanner stay 13*a*.

The scanner unit 4*a* is held to the scanner stay 13*a* at three points of the scanner stay 13*a*. It remains pressed by three leaf springs in the direction indicated by an arrow mark Z (vertical direction in this embodiment). The scanner stay 13*a* is fixed to the rear plate 10 of the main frame 50. Thus, the scanner stay 13*a* is equivalent to a component for fixing the scanner unit 4*a*, which is an image forming section, to the main frame 50, by which the scanner unit 4*a* is supported.

The scanner stay 13*a* has: a bottom section 33*c*, to which the scanner unit 4*a* is attached, and a pair of bent sections 33*a* and 33*b*, which are formed by bending in the direction Z the lengthwise ends (in terms of the direction Y) of the bottom section 33*c* and by which the scanner stay 13*a* is attached to the front stay 14*a*, and rear plate 10, respectively. Thus, the scanner unit 4*a* is held to the bottom section 33*c* of the scanner stay 13*a* by being pressed by the leaf springs, as described above. The reason why the scanner unit 4*a* is held to the bottom section 13*a* by the leaf springs as described above is that, even if the scanner stay 13*a* is deformed by heat, the deformation can be absorbed by the leaf springs to prevent the scanner unit 4*a* from deforming.

The scanner stay 13*a* is attached to the rear plate 10 (first supporting component) and front stay 14*a* (second supporting component), by the bent sections 33*a* and 33*b* so that the bent sections 33*a* and 33*b* become parallel to each other. The rear plate 10 and front stay 14*a*, as a pair of the first supporting components, oppose each other across the space in which the scanner unit 4*a* is disposed, being thereby positioned in parallel in the direction Z. The rear plate 10, and the front plate unit 14 which includes the front stay 14*a*, are connected to each other by the connective stays 18-23 as connective sections.

The bent section 33*a* is fixed to the rear plate 10 by its three sections 26, 27 and 28. As for the bent section 33*b*, it is fixed to the front stay 14*a* by its two connective sections 29 and 30. In this embodiment, each connective section includes a small screw. Further, the rear plate 10 which is one of the plates to which the scanner stay 13*a* is fixed, is provided with a slit 126 (first slit), a slit 127 (first slit), and a slit 128 (first slit), whereas the front stay 14*a*, which is the other plate to which the scanner stay 13*a* is fixed, is provided with a slit 129 (second slit) and a slit 130 (second slit). These slits are configured and positioned so that they are concentric with the connective sections (26, 27, 28, 29 and 30, respectively), and concentrically extend by no less than 180° about corresponding connective sections, respectively. That is, each of the slits 126-130 is configured and positioned so that it concentrically extends, in the shape of a letter C, about the corresponding connective section (hole) by no less than 180°. In this embodiment, the slits 126-130 are through holes in terms of the thickness direction of the bent sections 33*a* and 33*b*.

Here, the connective sections 26-28 are the sections of the bent sections 33*a*, by which the bent section 33*a* is fixed to the rear plate 10. The connective section 26 is on one side of the center (line B-B' in FIG. 5) of the scanner unit 4*a*, and the connective sections 27 and 28 are on the other side. More concretely, the left side of the bent section 33*a*, in terms of the direction X of the scanner unit 4*a*, is fixed to the rear plate 10 by the connective section 26, whereas the right side of the bent section 33*a* is fixed to the rear plate 10 by the connective sections 27 and 28. Further, the slits 126-128 are positioned on the center side of the bent section 33*a*, in terms of the direction X, relative to the connective sections 26 and 28. That is, the slit 126 is configured and positioned so that it encircles at least the right side of the connective section 26, in FIG. 5, whereas the slits 127 and 128 are positioned so that they encircle at least the left side of the connective sections 27 and 28, respectively, in FIG. 5.

Similarly, the connective section 29, which is one of the sections of the bent section 33*b* by which the scanner stay 13*a* is attached to the front stay 14*a*, is on one side of the centerline (line B-B' in FIG. 5) of the bent section 33*b*, whereas the connective section 30 is on the other side of the centerline (line B-B' in FIG. 5) of the bent section 33*b*. More concretely, the left side of the bent section 33*b* in FIG. 5, in terms of the direction X of the scanner unit 4*a*, is fixed to the front stay 14*a* by the connective section 29, whereas the right side of the bent section 33*b* in FIG. 5, is fixed to the front stay 14*a* by the connective section 30. Further, the slits 129 and 130 which concentrically surround the connective sections 29 and 30, respectively, are positioned on the center side of the bent section 33*b* in terms of the direction X, relative to the connective section 29 and 30. That is, the slit 129 which concentrically surrounds the left connective section 29 in FIG. 5 is configured so that it encircles at least the right side of the connective section 29. As for the slit 130 which is formed in the adjacencies of the right connective section 30 is positioned so that it encircles the left side of the connective section 30. These five slits 126-130 are the same in configuration, although they are different in the side of the corresponding connective section they encircle.

In this embodiment, as described above, the scanner stay 13*a*, by which the scanner unit 4*a* is held, is provided with the connective sections 26-28, by which the scanner stay 13*a* is attached to the rear plate 10, which is a part of the main frame 50. It is also provided with the slits 126-128 which concentrically surround the connective sections 26-28. Further, the scanner stay 13*a* is provided with the connective sections 29 and 30, by which the scanner stay 13*a* is attached to the front stay 14*a*, which also is a part of the main frame 50. It is also provided with the slits 129 and 130 which concentrically surround the connective sections 29 and 30. Thus, the load paths from the driving units supported by the main frame 50 to the scanner stay 13*a*, which go through the connective sections 26-30, are less in rigidity than the other load paths. In other words, the input load F in the above-described equation (1) is smaller, and therefore, the point of evaluation of the scanner stay 13*a*, and that of the scanner unit 4*a* are smaller in the amplitude X.

Here, it is the bent sections 33*a* and 33*b* of the scanner stay 13*a* that are provided with the slits 126-130. Therefore, there is an effect that the transfer characteristics H in equation (1), which is related to the transfer characteristic of a structure, is not increased for the following reason. That is, the slits, with which the bent sections 33*a* and 33*b* are provided, has little effect upon the transfer characteristic (characteristic frequency) of a "structural component" in terms of essential specific modes. As for the specific modes, there are a mode in which bottom section 33*c* of the scanner stay 13*a* vibrates, a mode in which the scanner unit 4*a* rigidly vibrates in the direction Z, and a mode in which the scanner unit 4*a* vibrates in a manner of being twisted. Therefore, if a slit is formed around the point of connection between the bottom section 33*c* and scanner unit 4*a*, for example, it is possible that a "structural component" will change in the above-described specific modes, and therefore, the "structural component" will increase the transfer characteristic H. Thus, even if the input load F can be reduced by the formation of the slit, the structural component increases in the transfer characteristics H. Therefore, it is possible that the amplitude X at the point of evaluation will not be reduced. In this embodiment, therefore, the bent sections 33*a* and 33*b*, which are unlikely to be affected by the vibrations in the above-described specific modes and also are unlikely to be changed in the specific modes by the formation of the slits, are provided with the slits.

[Configuration of Slit]

Next, referring to FIGS. 6 and 7, the configuration of each of the slits 126-130 formed as described above is described. By the way, the slits 126-130 are the same in configuration. Therefore, only the configuration of the slit 126 is described, as the one which represents all the slits. The slit 126 is formed so that it continuously encircles the connective section 26 by no less than 180°. In this embodiment, the scanner stay 13*a* is 1 mm in thickness, and the slit 126, which is positioned in a manner to encircle the connective section 26, is 15 mm in external diameter, 11 mm in internal diameter, and 270° in the angle θ of encirclement. That is, the slit 126 is in the form of an arc. The center of the slit 126 and the center of the connective section 26 (center of small screw) roughly coincide with each other.

The dimension of the slit 126 is optional, as long as the bent sections 33*a* and 33*b* remains sufficiently rigid (in other words, a part (connective section 26) does not break away). Regarding the dimension of the slit 126 in terms of the diameter direction, for example, the slit 126 may be formed so that its internal diameter becomes 11 mm, and its external diameter falls within a range of 15 mm-19.6 mm. Incidentally, the reason why the slit 126 was made to be 11 mm in internal diameter is to ensure that the connective section 26 is provided with an area (seat) for the head of a small screw. Regarding the angle θ of encirclement of the connective section 26 by the slit 126, as long as it is no more than 300°, the bent section 33*a* is provided with a sufficient amount of rigidity. Therefore, the angle θ is desired to be no more than 300°. However, in consideration of the fact that it is possible that the image forming apparatus 100 will fall during its shipment, and also, in consideration of the resultant vibrations and impact, the angle θ is desired to be no more than 270°, to afford some latitude in terms of rigidity. As for the smallest value for the angle θ, it is desired to be 180°, for the following reason.

FIGS. 7 and 6 are graphs which are related to the angle θ by which the slit 126 encircles the connective section 26. More specifically, they show the relationship between the angle θ of encirclement of the connective section 26 by the slit 126, and the ratio of change in the rigidity of the scanner stay 13*a*. The graphs show how much a structural component (formed of plate) changes in rigidity, compared to a structural component having no slit (that is, when θ=0), as the slit 126 is increased in the angle θ of encirclement. These results were obtained with the use of a finite element method (FEM). More concretely, referring to FIG. 6, the connective section 26 is restrained, and the reciprocal of the amount of positional deviation which occurred to the point (connective section 26) to which a unit amount of static load is applied from two directions, that is, horizontal direction Fx and vertical direction Fz in the drawing, is used as the amount of rigidity. Further, the slit 126 was formed so that it becomes symmetrical with reference the horizontal line C-C' to prevent the model from being rotated by the load.

Referring to FIG. 7, regarding the horizontal load Fx, as the slits 126 was increased in the angle θ of encirclement, the connective section 26 roughly linearly reduced in rigidity. It is evident from FIG. 7 that when the angle θ of encirclement of the slit 126 is 180°, the connective section 26 was roughly 28% less in rigidity. On the other hand, regarding the vertical load Fz, when the slit 126 is small in the angle θ of encirclement, it is not effective to reduce the connective section 26 in rigidity. However, as the slit 126 was increased in the angle θ of encirclement to no less than 180°, its effectiveness in reducing the connective section 26 in rigidity increased by the square of the amount by which the slit 126 was increased in the angle θ of encirclement. For example, when the angle θ of encirclement of the slit 126 was no more than 120°, the amount by which the connective section 26 was reduced in rigidity was no more than 5%. However, as the slit 126 was increased in the angle θ of encirclement to 180°, 240° and 300°, the connective section 26 was reduced in rigidity by 13%, 30% and 50%, respectively. Thus, it is evident that it is wanted to reduce the connective section 26 in rigidity with regard to all the directions from which load is inputted (loads Fx and Fz from driving units), the angle θ of encirclement of the slit 126, is desired to be no less than 180° (half of circumference). In this embodiment, the angle θ was set to 270° as described above. This configuration of the connective section 26 and its adjacencies is effective to reduce the connective section 26 in rigidity by roughly 40% with regard to both the horizontal and vertical input load Fx and Fz.

[Positioning of Slit]

Next, the slit 126 having the above-described angle θ of encirclement is described about its positioning relative to the connective section 26 of the scanner stay 13*a* is described. By the way, the positional relationship between the slits 129 and 130 of the scanner stay 13*a*, shown in FIG. 5, and the connective sections 29 and 30 of the scanner stay 13*a* is the same in concept as the positional relationship between the slit 126 and connective section 26. Hereinafter, therefore, only the positioning of the slits 129 and 130 relative to the connective section 29 and 30 of the front stay 14*a* is described in detail. That is, the positioning of the slits 126-128 relative to the connective section 26-28 of the rear plate 10 is not described.

Part (a) of FIG. 8 is a sectional view of the connective sections 29 and 30 of the front stay 14*a*, and the scanner stay 13*a*, respectively (at plane which coincides with center of connective section 29, and center of connective section 30, in FIG. 5). Referring to part (b) of FIGS. 8 and 8(*c*), the slits 129 and 130 are opposite in positioning (attitude) in terms of the direction X, as described above. The slits with which the scanner stay 13*a* is provided are intended to reduce the connective sections in rigidity in terms of all directions (input loads Fx and Fz from driving units). Therefore, they are formed in the above-described position and attitude. To elaborate this point, referring to part (a) of FIG. 8, because the bent section 33*b* of the scanner stay 13*a* is provided with the slits 129 and 130, the bent section 33*b* is compressed in the direction X by the load which comes from the direction Fx in the drawing. Therefore, the slits 129 and 130 are positioned on the scanner unit 4*a* side of the connective sections 29 and 30, in order to reduce in rigidity the load path of the bent section 33*b*, which is to be compressed in the direction X.

The slits with which the scanner unit 4*a* is provided are effective in a case where the load Fx is dominant. Thus, in a case where the load Fx is dominant, the slits may reversed in attitude. In essence, all that is necessary is that the slits are present in the path through which a load transmits to the scanner unit 4*a*, so that the presence of the slits reduces the path in rigidity. However, it is desired that the slits are placed in the dominant load transmission path between the connective section 29 and scanner unit 4*a*, and that between the connective section 30 and scanner unit 4*a*, for example.

In this embodiment, the bent section 33*a* is provided with the slits 126-128, which encircle the connective sections 26-28, respectively, by no less than 180°. Thus, it is possible to reduce the amount by which vibrations are transmitted to the scanner unit 4*a* from the driving units, in any of multiple transmission modes, even thought the means for preventing the vibration transmission is simple in structure. That is, the slits 126-128 are provided in the adjacencies of the connective sections 26-28, respectively, of the bent section 33*a*, by which the scanner stay 13*a* is attached to the rear plate 10 of the main frame 50 which supports various driving units. Further, the slits 129 and 130 are provided in the adjacencies of the connective sections 29 and 30, respectively, of the bent section 33*b*, by which the scanner stay 13*a* is attached to the front stay 14*a* of the main structure 50. Thus, the adjacencies of the connective sections 26-30 by which the scanner stay 13 is attached to the main frame 50 are smaller in rigidity than the other sections of the apparatus main assembly. Therefore, the amount by which load is inputted into the scanner stay 13*a* through the connective sections 26-30 is smaller. In other words, the load attributable to the vibrations from the driving units is transmitted by a greater amount to the other sections of the image forming apparatus, which are higher in rigidity than to the scanner stay 13*a* through the connective sections 26-30, from the main frame 50. Therefore, the scanner stay 13*a* is smaller in the amount by which it receives the vibrations attributable to the driving units. Therefore, the scanner unit 4*a* is smaller in the amount by which it receives the vibrations from the driving units. Therefore, the image forming apparatus is less likely to suffer from image defects such as pitch anomaly.

Further, a shock absorbing component, for example, formed of rubber or the like substance is not placed between the scanner stay 13*a* and main frame 50. Therefore, it is ensured that the scanner unit 4*a* and photosensitive drum 3 remain precisely positioned relative to each other. In particular, in this embodiment, no shock absorbing component is provided even between the scanner unit 4*a* and scanner stay 13*a*. Therefore, the scanner unit 4*a* and photosensitive drum 3 remain precisely positioned to each other at a higher level accuracy. By the way, if an elastic component formed of rubber or the like substance is used to reduce the amount by which vibrations are transmitted to the scanner unit 4*a*, it is possible that the elastic component will be made to deteriorate by environmental causes and/or elapse of time, and therefore, will fail to continuously reduce the amount by the vibrations are transmitted to the scanner unit 4*a*. In comparison, in this embodiment, such an elastic component is not employed, and therefore, it is possible to continuously reduce the amount by which vibrations are transmitted to the scanner unit 4*a* for a long period of time.

Embodiment

Next, referring to FIG. 9, the tests conducted to confirm the effectiveness of this embodiment are described. FIG. 9 shows the results of the comparison, in terms of vibration amplitude, between an image forming apparatus, the bent sections 33*a* and 33*b* of the scanner stay 13*a*, which are provided with the slits 126-130 in the shape of a letter C as described above, and an image forming apparatus which is not provided with the slits 126-130. In the tests, vibrations are applied to the main frame 50 under two conditions, that is, the first and second conditions, and the vibrations were measured in amplitude at various frequencies. In the first condition (vibration 1), it is assumed that the fixing device driving unit 12 is the driving force source. The fixing device driving unit 12 is attached to the rear plate 10 (vibration is transmitted in direction Z). Thus, a vibration generator was positioned in the adjacencies of the fixing device driving unit 12. As for the second condition (vibration 2), it is assumed that the vibration source is the toner recovering device driving unit 25 attached to the rear plate 10 (vibration is transmitted in direction Z). Thus, the driving force source of which is attached to the front plate unit 14. Thus, the vibration generator was positioned in the adjacencies of the toner recovering device driving unit 25.

In the tests, the main frame 50 shown in FIG. 2 was used. As the point of evaluation, the second mirror 204 of the scanner unit 4*b* for black component was selected for both tests. Regarding vibration generation, if the driving units are operated as the vibration sources, that is, if the gear trains and motor are operated, the evaluation is done for only the specific frequency. In this embodiment, therefore, vibration generators were placed in the adjacencies of the driving force source as described above. Further, the point of evaluation was evaluated in the amplitude of the vibration, under the same condition in terms of vibration, across the entire spectrum of vibration in terms of frequency. That is, the vibration generators were kept stable in the amount (amplitude) of vibration, and were gradually varied in frequency in a manner to sweep the entire frequency range. The vibrations were measured in amplitude at the points of evaluation. In these tests, the vibrations were changed in frequency within a range of 0-1280 Hz. Further, the vibrations were generated for a length of 1.6 seconds at each frequency.

"No vibration" (dotted line) in FIG. 9 indicates the vibration level (amplitude) of the connective sections having no slit. A solid line stands for the vibration level (amplitude) of the connective section having the slits 126-130. Numbers 1, 2 and 3 (models 1, 2 and 3) surrounded by circles stand for the range of each of specific modes extracted and separated with the use of the modal tests carried out independently from the vibration tests. By the way, "modal test" is a vibration test to be carried out to identify the dynamic characteristics (mode characteristic) of an object. In the vibration test, vibrations are applied to a given point of the main frame 50 as an object to vibrated. Then, both the vibration input and acceleration are measured to extract the characteristics of the second mirror 204 as the object to be tested. As the items in the above-described equation (1) are substituted with the thus obtained values (characteristics), the acceleration is X; characteristics of the object to be tested, H; and vibration input is F. In these tests, the vibrations peaked in amplitude across three specific mode ranges, under both the first and second conditions (vibrations 1 and 2).

As is evident from part (a) of FIGS. 9 and 9(*b*), providing the slits reduces the point of evaluation in the amplitude of vibration in each specific mode, regardless of the condition. Part (c) of FIG. 9 is a graph that shows the relationship between the amount by vibrations wee reduced in amplitude and three specific modes. It shows the ratio of the average amplitude value in each of three mode (modes 1, 2 and 3) in part (a) of FIGS. 9 and 9(*b*), relative to that when no slit was provided. Therefore, if the vibrations are reduced in amplitude, the ratio of change in amplitude becomes negative. As is evident from part (c) of FIG. 9, by forming a slit in the immediate adjacencies of the connective section as in this embodiment, it is possible to reduce the connective section in the amplitude of the vibration, regardless of the direction (vibrations 1 and 2) in which vibrations are transmitted to the connective section, in all the specific modes (modes 1, 2 and 3).

Embodiment 2

Next, referring to FIG. 10, the second embodiment of the present invention is described. In the case of this embodiment, the front stay 14*a* is provided with positioning sections for precisely positioning the scanner stay 13*a* and front stay 14*a* relative to each other, in addition to the structural arrangements provided in the first embodiment. Otherwise, the structural components in this embodiment, and their functions, are the same as the counterparts in the first embodiment. Hereafter, therefore, description is focused upon the difference of this embodiment from the first embodiment.

The front stay 14*a* is provided with a pair of positioning pins 31*a* and 31*b*, which are integrally formed with the front stay 14*a* or formed independently from the front stay 14*a* and then attached to the front stay 14*a*. On the other hand, the bent portion 33*b* of the scanner stay 13*a* is provided with a pair of holes 32*a* and 32*b*, as positioning holes, into which the positioning pins 31*a* and 31*b* can be fitted. Thus, the scanner stay 13*a* can be precisely positioned relative to the front stay 14*a* when the scanner stay 13*a* is attached to the main frame 50. Further, it is possible to prevent the problem that, with the elapse of time, the front stay 14*a* and scanner stay 13*a* deviate in position from each other due to the slippage or the like of small screws.

More specifically, one of the two positioning pins 31*a* and 31*b* is used to precisely position the front stay 14*a* and scanner stay 13*a* relative to each other in terms of both the directions X and Y, and the other pin 31 is used to precisely position the front stay 14*a* and scanner stay 13*a* in terms of the direction Z. In this embodiment, therefore, one of the holes 32*a* and 32*b* was made round, whereas the other was elongated in the direction Z so that the front stay 14*a* and scanner stay 13*a* are precisely positioned relative to each other in terms of the direction parallel to the short axis of the elongated hole 32. For example, the hole 32*a* was made perfectly round, whereas the hole 32*b* was given an elongated round shape. Thus, the positioning pins 31*a* and 31*b* are fitted into the holes 32*a* and 32*b*, respectively, to precisely position the scanner stay 13*a* relative to the front stay 14*a*. Then, the scanner stay 13*a* was fixed to the front stay 14*a* with the use of small screws.

These positioning sections which are in the adjacencies of the connective sections 29 and 30 do not have strength like a small screw. Therefore, it hardly occurs that this positioning structure negatively affects the effectiveness of the slits. This invention is based on the idea of diverting the load F inputted into a structural component, to a specific path by reducing the specific path in rigidity relative to other paths. In other words, it is not intended to absorb (attenuate) the vibrations. Therefore, it is possible to reduce the amount by which vibrations are transmitted to each scanner unit 4, while ensuring that each scanner unit 4 and corresponding photosensitive drum 3 remain precisely positioned relative to each other. By the way, in this embodiment, the positioning protrusions were in the form of a pin. However, they may be in the form of a structural component formed by embossing, or by cutting-and-bending (perpendicularly erecting) parts of the front stay 14*a*. Further, it may be the scanner stay 13*a* that is provided with the positioning protrusions, whereas it may be the front stay 14*a* that is provided with the positioning holes. Moreover, it is not mandatory that the rear plate 10 and scanner stay 13*a* are provided with positioning components such as the above-described ones.

Embodiment 3

Next, referring to FIG. 11, the third embodiment of the present invention is described. In each of the above-described embodiments, it was the scanner stay 13*a* that was provided with the slits. In comparison, in this embodiment, it is the main frame 50 (FIG. 2) that is provided with the slits. By the way, the concept of providing a slit in the adjacencies of the connective sections by which the scanner stay 13*a* are fixed to the rear plate 10 is the same in principle as the concept of providing the adjacencies of the connective sections by which the scanner stay 13*a* is connected to the front stay 14*a*. Therefore, only the slits 229 and 230 with which the connective sections 29 and 30 by which the scanner stay 13*a* is connected to the front stay 14*a* are described in detail. That is, the connection between the scanner stay 13*a* and rear plate 10 is not described.

Referring to FIG. 11, the adjacencies of the connective sections 29 and 30 of the front stay 14*a* are provided with slits 229 and 230, respectively. The slits with which the main frame 50 for holding the scanner stay 13*a* is provided are different in the phase (direction) from the slits with which the scanner stay 13*a* is provided in each of the preceding embodiments. More concretely, the slits 229 and 230 are on the opposite side of the connective sections 29 and 30, respectively, from the centerline B-B' of the scanner unit 4*a*.

More concretely, the connective sections 29 and 30 are the sections by which the bent section 33*b* and front stay 14*a* are connected to each other on one side of the scanner unit 4*a* and the other, respectively, relative to the center line B-B' of the scanner unit 4*a*. That is, the slit 229, which is in the adjacencies of the left connective section 29 (shown in part (a) of FIG. 11) extends in a manner of encircling at least the right side of the connective section 29, as shown in part (c) of FIG. 11. As for the slit 230, which is in the adjacencies of the left connective section 30 shown in part (a) of FIG. 11, the slit 230 extends in a manner to encircle at least the left side of the connective section 30, as shown in part (b) of FIG. 11. In other words, the slits are reversed in position, depending on which component is provided with the slits.

In this embodiment, in order to deal with the load which comes from the direction Fx in the drawing, the path from the connective sections 29 and 30 to the scanner stay 13*a* is reduced in rigidity on the front stay 14*a* side. Thus, the slits are positioned on the opposite side of the connective sections 29 and 30 from the center line B-B' of the scanner unit 4*a*. By the way, it is when the Fx load is dominant that positioning the slits as described above is effective to reduce the amount by which vibrations are transmitted to the connective sections 29 and 30. Therefore, in a case where the Fx load is dominant, even if it is the front stay 14*a*, or the like, of the main frame 50 that is provided with the slits, the slits may be positioned as in the first embodiment. Further, this embodiment is especially effective in a case where the load Fx is transmitted from the outward side of the connective sections 29 and 30 (opposite side from center of the scanner unit 4*a*). That is, in a case where the front stay 14*a* or the like of the main frame 50 is provided with the slits, the slits are desired to be on the upstream side of the connective sections 29 and 30, in terms of the direction in which the load is transmitted from the vibration source to the scanner unit 4*a*. As described above, this embodiment can reduce the amount by which load is inputted into the scanner stay 13*a* by way of the connective sections 29 and 30. Except for the above-described structural components and the functions thereof, this embodiment is the same as each of the above-described embodiments.

Embodiment 4

Next, referring to FIG. 12, the fourth embodiment of the present invention is described. In this embodiment, both the main frame 50 (FIG. 2) and scanner stay 13*a* were provided with the slits, which were placed in the adjacencies of the connective sections. That is, the scanner stay 13*a* is provided with the slits 129 and 130 as in the first embodiment, as shown in FIG. 8, and also, the front stay 14*a* of the main frame 50 is provided with connective section return screw 229 and 230 as in the third embodiment, as shown in FIG. 11. With the provision of the four slits 129, 130, 229 and 230 in the adjacencies of the connective sections 29 and 30, the load path to the scanner stay 13*a* is further reduced in rigidity, and therefore, the amount by which vibrations are transmitted through the load path is further reduced. By the way, the concept of placing the slits in the adjacencies of the connective sections by which the scanner stay 13*a* is connected to the rear plate 10, is the same in principle as the concept of placing the slits in the connective sections by which the scanner stay 13*a* is connected to the front stay 14*a*. Further, except for the above-described structural arrangements and their effects, this embodiment is the same as each of the above-described embodiments.

Embodiment 5

Next, referring to FIG. 13, the fifth embodiment of the present invention is described. In each of the above-described embodiments, the slits were formed so that they extend in a manner to encircle the corresponding connective sections by no less than 180°. In comparison, in this embodiment, two or more slits are provided in the adjacencies of each connective section so that the combination of the slits encircles the connective sections by no less than 180°. Although this embodiment is described with reference to only the slits in the adjacencies of the connective section 26, the slits in the adjacencies of the other connective sections are the same as those in the adjacencies of the connective section 26.

Referring to FIG. 13, there are provided multiple slits in the adjacencies of the connective section 26. These slits are different in position in terms of the radius direction of the connective section 26. The center of curvature of each slit coincides with the center of the connective section 26. More concretely, in this embodiment, the multiple slits 326*a*, 326*b*, 426*a* and 426*b* are provided in the adjacencies of the connective section 26. It may be either the main frame 50 or scanner stay 13*a* that is provided with the slits 326*a*, 326*b*, 426*a* and 426*b*. In this embodiment, it is the bent section 33*a* of the scanner stay 13*a* that is provided with the slits 326*a*, 326*b*, 426*a* and 426*b*. Further, the multiple slits 326*a*, 326*b*, 426*a* and 426*b* are configured and positioned so that the connective section 26 are entirely encircled by the combination of the slits 326*a*, 326*b*, 426*a* and 426*b*.

To describe more concretely, the slits 326*a* and 326*b* are positioned so that they coincide with a circle, the center of which coincides with the center of the connective section 26 (axial line of small screw), whereas the slits 426*a* and 426*b* are positioned so that they coincide with another circle, which are greater in radius than the first circle, and the center of which coincides with the center of the connective section 26. That is, the pair of slits 326*a* and 326*b* are configured and positioned so that they coincide with the inner of the two circles which are different in radius, and the center of which coincides with that of the connective section 26, whereas the pair of slits 426*a* and 426*b* are configured and positioned so that they coincide with the outer of the two circles. Further, in terms of the vertical direction (direction Z) in FIG. 13, the slits 326*a* and 326*b* are positioned so that the former is on the bottom side of the connective section 26, whereas the latter is on the top side of the connective section 26. As for the slits 426*a* and 426*b*, they are positioned on the left and right sides, respectively, of the connective section 26 in terms of the left-right direction (direction X) in FIG. 13. Further, they are symmetrically positioned with reference to the center of the connective section 26. Moreover, the slits 326*a* and 326*b* extend in a manner to encircle the connective section 26 by 120°. Further, they are positioned so that their one half extends leftward of a line which is parallel to the direction Z and coincides with the center of the connective section 26, by a distance equivalent to 60° and the other half extends rightward of the line which is parallel to the direction Z. As for the slits 426*a* and 426*b*, they extend in the direction parallel to the circumferential direction of the connective section 26 by a distance equivalent to 120°. More specifically, they are positioned so that their top half, with reference to the horizontal line which coincides with the center of the connective section 26, extends upward by a distance equivalent to 60°, and the bottom half extend downward by a distance equivalent to 60°. Thus, the combination of the multiple slits 326*a*, 326*b*, 426*a* and 426*b* entirely encircles the connective section 26 while overlapping with each other in terms of the circumferential direction of the connective section 26. In a case where multiple slits are configured and positioned so that they overlap with each other in terms of the circumferential direction of the connective section 26, it is desired, from the standpoint of reducing the amount by which vibrations are transmitted through the connective sections, that the combination of the adjacent two slits continuously encircles the connective section 26 by no less than 180°.

More concretely, the scanner stay 13*a* was made to be 1.0 mm in thickness. Further, the inward slits 326*a* and 326*b* were made to be 8 mm in internal diameter, 11 mm in external, and 120° in the angle θ of encirclement, whereas the outward slits 426*a* and 426*b* were made to be 15 mm in internal diameter, 18 mm in external diameter, and 120° in the angle θ of encirclement.

In this embodiment, the connective section 26 is entirely encircled by the combination of multiple slits. Therefore, the amount by which vibrations are transmitted to the connective section 26 are satisfactorily reduced whether the vibrations come from the direction X (load Fx) or Z (load Fz). By the way, the configuration, numbers, and angle θ of encirclement can be properly set by a static rigidity test which uses the above-described finite element method (FEM). Sections, in this embodiment, other than the above-described ones are the same in structure and function as the counterparts in each of the above-described preceding embodiments.

Embodiment 6

Next, referring to FIG. 14, the sixth embodiment of the present invention is described. In the description of each of the above-described embodiments, focus was on the sections of the scanner stay 13*a* (including their adjacencies) by which the scanner stay 13*a*, which holds the scanner unit 4*a*, is connected to the main assembly 50. However, the pitch anomaly attributable to the vibrations of the driving units attached to the main frame is a problem attributable to the positional deviation between the beam of laser light projected from the scanner unit 4*a*, and the photosensitive drum. Therefore, the pitch anomaly also occurs for the following reason. That is, the vibrations having occurred within the driving units reach the photosensitive drum 3 through the main frame and cause photosensitive drum 3 to vibrate. As a result, the positional relationship between the beam of laser light and photosensitive drum 3 periodically changes. Consequently, the pitch anomaly occurs. In this embodiment, therefore, the present invention was applied to the point of connection between the cartridge holding frame 51, which is the portion of the process cartridge, by which the photosensitive drum 3, which is an image bearing component, is held, and the main frame 50. By the way, the slits formed in the adjacencies of the connective sections in this embodiment are basically the same as those formed in the adjacencies of the point of connection between the scanner unit 4*a* and main assembly 50. Therefore, the sections of the point of connection between the cartridge supporting frame 51 and main frame 51, in this embodiment, which are similar to the counterparts in each of the above-described embodiments, are not described at all, or is described only briefly. Further, they are not illustrated at all, or is described only schematically. That is, the description of this embodiment is focused on the sections of this embodiment, that characterize this embodiment.

FIG. 14 is a sectional view of the structural components by which the process cartridge 2, which includes the photosensitive drum 3, is held to the main frame 50. The process cartridge 2 which contains the photosensitive drum 3 is held by the cartridge supporting frame 51 as a section by which the photosensitive drum 3 is fixed to the main frame 50. The cartridge supporting frame 51 is made up of four components, more specifically, stays 34, 35, 36 and 37, which are attached to each other with the use of small screws 44-47. The cartridge supporting frame 51 is connected to the rear plate 10 and front stay 14*a* of the main frame 50. That is, a pair of stays 34 and 35 are connected to the front stay 14*a* and rear plate 10, respectively. The front stay 14*a* and rear plate 10 are a pair of supporting sections which are positioned on one side of the space, in which the photosensitive drum 3 is placed, and the other.

Concretely, the front stay 14*a*, which is a supporting plate for supporting the cartridge supporting frame 51 and stay 34, by one side of the cartridge supporting frame 51 and stay 34, and are connected to each other at connective sections 38 and 39 (with use of small screws). Further, the rear plate 10, which is the supporting plate on the other side, and the cartridge stay 35, which is the fixing plate on the other side, are positioned relative to each other at positioning sections 40 and 41. The positioning section 40 is a combination of a positioning pin 42*a*, and a positioning hole 43*a* in which the positioning pin 42*a* fits. The positioning section 41 is a combination of a positioning pin 42*b*, and a positioning hole 43*b* in which the positioning pint 42*b* fits.

The positioning pin 42*a* and 42*b* are formed as integral parts of the stay 35, or separately formed from the stay 35 and attached to the stay 35. On the other hand, the rear plate 10 is provided with the positioning holes 43*a* and 43*b*, into which the positioning pins 34*c* and 34*d* can be fitted. In this embodiment, one of the positioning holes 43*a* and 43*b* is formed round, and the other is given an elongated round shape, the long axis of which is parallel to the direction Z. That is, the positioning holes 43*a* and 43*b* are configured so that the stay 35 and rear plate 10 align in the direction parallel to the short axis of the elongated hole. For example, the positioning hole 43*a* is made to be round, whereas the positioning hole 43*b* may be elongated.

Further, in this embodiment, the cartridge stay 34 of the cartridge supporting frame 51 is provided with a pair of slits 138 and 139, which are formed in the adjacencies of the connective sections 38 and 39, respectively, and positioned as shown in part (b) of FIGS. 14 and 14(*c*). The details of the configuration and positioning of the slits 138 and 139 are the same as those of the slits shown in FIG. 6. The positioning of the slits 138 and 139 in terms of attitude relative to the connective section is the same as the slits shown in FIG. 8. That is, the connective section 38 is on one side of the rotational axis of the photosensitive drum 3, whereas the connective section 39 is on the other side. The connective sections 38 and 39 connect the cartridge stay 34 to the front stay 14*a*. The cartridge stay 34 is provided with the slits 138 and 139, which are configured and positioned so that they are on the photosensitive drum side of the connective sections 38 and 39, respectively.

The cartridge stay 35 of the cartridge supporting frame 51 is provided with a pair of slits 140 and 141, which are positioned in the adjacencies of the positioning sections 40 and 41, respectively, as shown in part (d) of FIGS. 14 and 14(*e*). The details of the configuration and positioning of the slits 140 and 141 are the same as those of the above-described slits 138 and 139, and therefore, they are not described here.

In this embodiment, the cartridge stay 35 of the cartridge supporting frame 51, and the rear plate 10 are not connected to each other with the use of small screws. They are positioned relative to each other, and held to each other, only by the engagement between the positioning pins 34*c* and 34*d*, and positioning holes. Therefore, unlike the second embodiment shown in FIG. 10, the rear end portion of the cartridge supporting frame 51 is supported by the rear plate 10, and is positioned by the engagement between the positioning pins 42*a* and 42*b*, and positioning holes 43*a* and 43*b*, respectively. In this embodiment, therefore, the points of engagement between the positioning pin 42*a* and 42*b*, and positioning holes 43*a* and 43*b* have a sufficient amount of retention force. Therefore, these points may be deemed connective sections (elements). These points of engagement function as positioning sections 40 and 41.

Also in this embodiment, the slits 138 and 139 are provided in the adjacencies of the connective sections 38 and 39, respectively, and the slits 140 and 141 are provided in the adjacencies of the positioning sections 40 and 41. Therefore, it is possible to reduce in rigidity the path through which vibrations (load) is inputted into the cartridge supporting frame 51, no matter from which direction the load is inputted. Therefore, it is possible to reduce the amount by which the photosensitive drum 3 is made to vibrate by the vibrations from the driving units. Therefore, it is possible to prevent the occurrence of image defects such as pitch anomaly.

The above-described slit configuration and slit positioning are not intended to limit this embodiment in terms of slit configuration and slit positioning. That is, this embodiment is compatible with all of the slit configurations and slit positioning in each of the preceding embodiments.

<Miscellanies>

In the first to fifth embodiments, the bent sections 33*a* and 33*b*, rear plate 10, and front stay 14*a* are formed of a piece of metallic plate or the like, and at least one of them is provided with slits. However, a component which is not provided with slits does not need to be flat. For example, in a case where the bent sections 33*a* and 33*b*, by which the scanner stay 13*a* is attached to the main frame 50, are provided slits, the supporting sections of the main frame 50, to which the bent sections 33*a* and 33*b* are attached, do not need to be formed of a piece of metallic plate or the like. For example, they may be columnar. Similarly, in a case where the rear plate 10 and front stay 14*a*, which are formed of a piece of metallic plate or the like, and by which the scanner stay 13*a* is supported, are provided with slits, the sections of the scanner stay 13*a*, by which the scanner stay 13*a* is attached to the rear plate 10 and front stay 14*a* do not need to be flat. For example, they may be columnar. Similarly, also in the case of the sixth embodiment, at least one of the cartridge stays 34 and 35 which are formed of a piece of metallic plate or the like, and at least one of the rear plate 10 and front stay 14*a*, are provided with slits. However, the component which is not provided with slits does not need to be flat.

Further, in the first to fifth embodiments, the slits were provided in the adjacencies of the connective sections, by which the scanner stay 13*a* which holds the scanner unit 4*a*, is connected to the main frame 50. However, these embodiments are not intended limit the present invention in scope in terms of the configuration and positioning of the slits. For example, the slits may be provided in the adjacencies of the points of connection between the scanner unit 4*a* and scanner stay 13*a*. Here, in a case where the slits are provided in the adjacencies of the points of connection between the bottom plate 33*c* of the scanner stay 13*a*, and the scanner unit 4*a*, it is possible that the main frame will change in specific mode, and therefore, will increase in transmission characteristics H. However, in certain cases, the main structure does not increase in transmission characteristics H, even if the slits are provided in the abovementioned connective section, although it depends on the transmission characteristics of the main structure (structural component). Even in a case where the structural component increases in transmission characteristics H, as long as the amount by which the slits reduces the amount by which the inputted load is transmitted is greater than the increase in the transmission characteristics H of the structural component, the slits may be provided in this area.

Further, the connecting means does not need to be limited to a small screw. That is, means other than a small screw may be employed as long as it can keep connected, the holding section and the section to be held. For example, the holding section and the section to be held, may be connected to each other with the use of a combination of a nut and a bolt, crimping, welding, or engagement between a protrusion, and a recess or hole.

Further, the present invention is applicable to such an image forming apparatus as a copying machine, a printing machine, a facsimile machine, a multifunction machine capable of performing two or more functions of the preceding machines, etc. Moreover, the present invention is also applicable to a monochromatic image forming apparatus, in addition to a full-color image forming apparatus. Further, the present invention is applicable to an image forming apparatus of the so-called direct transfer type, in addition to an image forming apparatus of the so-called intermediary transfer type, such as the one described above. That is, the present invention is applicable to various conventional image forming apparatuses which are different in structure.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-057876 filed on Mar. 20, 2015, which is hereby incorporated by reference herein in its entirety.

What is claimed is:

1. An image forming apparatus comprising:

(a) an image forming unit including:

(i) a photosensitive member;

(ii) a scanner unit configured to expose said photosensitive member to light to form an electrostatic latent image on said photosensitive member; and (iii) a developing device configured to develop the electrostatic latent image with toner, wherein said image forming unit is configured to form an image on a recording material by transferring a toner image developed on said photosensitive member onto the recording material;

(b) a holding portion including a plate-like stay holding said scanner unit, said plate-like stay having (i) a substantially horizontal portion with a supporting surface supporting said scanner unit at a bottom of said scanner unit, and (ii) a substantially vertical fixing portion bent and extended from an end of said horizontal portion;

(c) a supporting portion including a first substantially vertical side plate and a second substantially vertical side plate, said second side plate having (i) a part opposed to said fixing portion and (ii) a motor holding portion holding a motor for rotating said photosensitive member, wherein said plate-like stay is fixed to said first side plate and to said second side plate so as to extend therebetween;

(d) screws fixing said fixing portion to said second side plate, said screws having respective heads; and (e) arcuate slit portions provided in at least one of said substantially vertical second side plate and said substantially vertical fixing portion, said arcuate slit portions having a C-shape surrounding said heads of said screws in a range not less than 180° and less than 360° to suppress transmission of vibration caused by the motor held by said second side plate to said scanner unit through said holding portion, wherein said arcuate slit portions are substantially symmetrical with respect to a line connecting centers of said screws, and an open portion of each of said arcuate slit portions open away from each other.

2. An apparatus according to claim 1, wherein said arcuate slit portions are provided in said second side plate.

3. An apparatus according to claim 1, wherein said arcuate slit portions are formed in said fixing portion at positions on a line perpendicular to a vertical direction and along said second side plate, wherein said fixing portion includes:

(1) a first surface surrounded by a first one of said arcuate slit portions and having a fastening hole with which a first one of said screws is fastened;

(2) a second surface surrounded by a second one of said arcuate slit portions and having a fastening hole with which a second one of said screws is fastened;

(3) a surrounding surface provided around said first surface and said second surface;

(4) a first connecting surface provided between end portions said first one of said arcuate slit portions with respect to a circumferential direction thereof and connecting said first surface and said surrounding surface with each other; and (5) a second connecting surface provided between end portions of second one of said arcuate slit portions with respect to a circumferential direction thereof and connecting said second surface and said surrounding surface with each other, and wherein said first connecting surface and said second connecting surface are disposed at opposite sides of an area interposed between a first vertical line and a second vertical line, the first vertical line passing through a center of said screw, and the second vertical line passing through a center of said other screw.

4. An image forming apparatus comprising:

(a) an image forming unit including:

(i) a photosensitive member;

(ii) a scanner unit configured to expose said photosensitive member to light to form an electrostatic latent image on said photosensitive member; and (iii) a developing device configured to develop the electrostatic latent image with toner, wherein said image forming unit is configured to form an image on a recording material by transferring a toner image developed on said photosensitive member onto the recording material;

(b) a holding portion including a plate-like stay holding said scanner unit, said plate-like stay having (i) a substantially horizontal portion with a supporting surface supporting said scanner unit at a bottom of said scanner unit, (ii) a first substantially vertical fixing portion, and (iii) a second substantially vertical fixing portion, wherein said supporting surface is between said first fixing portion and said second fixing portion;

(c) a first substantially vertical side plate having a part opposed to said first fixing portion;

(d) a second substantially vertical side plate having a part opposed to said second fixing portion and holding a motor for rotating said photosensitive member;

(e) first screws fixing said first fixing portion to said first side plate, said first screws having respective heads;

(f) second screws fixing said second fixing portion to said second side plate, said second screws having respective heads;

(g) first slit portions each including a first arcuate slit provided in at least one of said first substantially vertical side plate and said first substantially vertical fixing portion, said first slit portions having a C-shape surrounding said heads of said first screws, respectively, in a range not less than 180° and less than 360°; and (h) second slit portions each including a second arcuate slit provided in at least one of said second substantially vertical side plate and said second substantially vertical fixing portion, said second slit portions having a C-shape said heads of said second screws, respectively, in a range not less than 180° and less than 360° to suppress transmission of vibration caused by the motor held by said second side plate to said scanner unit through said holding portion, wherein said first and second arcuate slit portions are substantially symmetrical with respect to a line connecting centers of said first and second screws, respectively, and an open portion of each of said arcuate slit portions open away from each other.

5. An apparatus according to claim 4, wherein said first slit portions are provided in said first side plate.

6. An apparatus according to claim 5, wherein said second slit portions are provided in said second slide plate.

7. An apparatus according to claim 4, wherein said first fixing portion includes:

(1) a first surface surrounded by a first one of said first slit portions and having a fastening hole with which a first one of said first screws is fastened;

(2) a second surface surrounded by a second one of said first slit portions and having a fastening hole with which a second one of said first screws is fastened;

(3) a first surrounding surface provided around said first surface and said second surface;

(4) a first connecting surface provided between end portions of said first one of said first slit portions with respect to the circumferential direction thereof and connecting said first surface and said first surrounding surface with each other; and (5) a second connecting surface provided between end portions of said second one of said first slit portions with respect to the circumferential direction thereof and connecting said second surface and said first surrounding surface with each other, wherein said first connecting surface and said second connecting surface are disposed at opposite sides of an area interposed between a first vertical line and a second vertical line, the first vertical line passing through a center of said first one of said first screws and the second vertical line passing through a center of said second one of said first screws, wherein said second fixing portion includes:

(1) a third surface surrounded by a first one of said second slit portions and having a fastening hole with which a first one of said second screws is fastened;

(2) a fourth surface surrounded by a second one of said second slit portions and having a fastening hole with which a second one of said second screws is fastened;

(3) a second surrounding surface provided around said third surface and said fourth surface;

(4) a third connecting surface provided between end portions of said first one of said second slit portions with respect to the circumferential direction thereof and connecting said third surface and said second surrounding surface with each other; and (5) a fourth connecting surface provided between end portions of said second one of said second slit portions with respect to the circumferential direction thereof and connecting said fourth surface and said second surrounding surface with each other, and wherein said third connecting surface and said fourth connecting surface are disposed at opposite sides of an area interposed between a third vertical line and a fourth vertical line, the third vertical line passing through a center of said first one of said second screws and the fourth vertical line passing through a center of said second one of said second screws.

* * * * *